US010518532B2

(12) United States Patent
Sugai

(10) Patent No.: US 10,518,532 B2
(45) Date of Patent: Dec. 31, 2019

(54) LIQUID EJECTING APPARATUS

(71) Applicant: SEIKO EPSON CORPORATION, Tokyo (JP)

(72) Inventor: Keigo Sugai, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/205,068

(22) Filed: Nov. 29, 2018

(65) Prior Publication Data

US 2019/0160815 A1 May 30, 2019

(30) Foreign Application Priority Data

Nov. 30, 2017 (JP) ..... 2017-229813

(51) Int. Cl.
*B41J 2/14* (2006.01)

(52) U.S. Cl.
CPC .. *B41J 2/14201* (2013.01); *B41J 2002/14241* (2013.01); *B41J 2202/05* (2013.01)

(58) Field of Classification Search
CPC combination set(s) only.
See application file for complete search history.

(56) References Cited

U.S. PATENT DOCUMENTS 4,380,018 A * 4/1983 Andoh ..... B41J 2/14298 346/47
2011/0228012 A1 9/2011 Yoshida et al.

FOREIGN PATENT DOCUMENTS

JP H04-078383 A 3/1992
JP 2001-063047 A 3/2001
JP 2011-213094 A 10/2011

* cited by examiner

*Primary Examiner* — Geoffrey S Mruk
(74) *Attorney, Agent, or Firm* — Workman Nydegger

(57) ABSTRACT

A liquid ejecting apparatus includes: a nozzle; a pressure chamber; a flow channel which is connected to the pressure chamber; a flow channel wall portion that changes a flow channel resistance of the flow channel; and an actuator that displaces the flow channel wall portion. An displacement amplifying mechanism is provided between the actuator and the flow channel wall portion. The displacement amplifying mechanism includes an elastic material that is elastically deformed by displacement of the actuator, and an accommodation chamber that is partitioned from the flow channel by the flow channel wall portion and accommodates the elastic material. A first portion of the elastic material receiving a pressure from the actuator, a second portion of the flow channel wall portion being bent and deformed between the flow channel and the accommodation chamber by receiving a pressure from the elastic material, an area of the second portion being less than an area of the first portion.

10 Claims, 9 Drawing Sheets

LIQUID EJECTING APPARATUS

BACKGROUND

1. Technical Field

The present invention relates to a liquid ejecting apparatus.

2. Related Art

In the related art, various liquid ejecting apparatuses have been proposed which eject a liquid to be discharged accommodated in a pressure chamber from a nozzle communicating with the pressure chamber by applying a pressure to the liquid to be discharged by an actuator. Examples of the liquid ejecting apparatuses include an apparatus in which an inner wall surface of a flow channel for a liquid, the flow channel being connected to a pressure chamber, is displaced by an actuator, so that a flow channel resistance of the flow channel is variably controlled (for example, JP-A-2001-63047 and JP-A-2011-213094).

In the above-described liquid ejecting apparatus, it is preferable that in order to increase accuracy of ejection of liquid, the pressure of a pressure chamber be controlled with higher accuracy. Thus, even when a flow channel resistance of a flow channel for a liquid, the flow channel being connected to the pressure chamber, is controlled, it is preferable that the flow channel resistance can be adjusted more widely, and it is preferable that the flow channel resistance can be changed more rapidly such that response lag is suppressed. It is preferable that the control of the flow channel resistance be realized by a simpler configuration.

SUMMARY

The invention can be realized in the following aspects.

[1] According to an aspect of the invention, there is provided a liquid ejecting apparatus. The liquid ejecting apparatus includes: a nozzle that discharges a liquid; a pressure chamber that communicates with the nozzle, accommodates the liquid, and generates a pressure for discharging the liquid from the nozzle; a flow channel which is connected to the pressure chamber and through which the liquid flows; a flow channel wall portion that constitutes a part of a wall surface of the flow channel, is displaced to change a cross-sectional area of a part of the flow channel, and changes a flow channel resistance of the flow channel; and an actuator that displaces the flow channel wall portion. An displacement amplifying mechanism for increasing a displacement amount of the flow channel wall portion more than a displacement amount of the actuator is provided between the actuator and the flow channel wall portion. The displacement amplifying mechanism includes an elastic material that is connected to the actuator and is elastically deformed by displacement of the actuator, and an accommodation chamber that is partitioned from the flow channel by the flow channel wall portion and accommodates the elastic material on the flow channel wall portion. A first portion of the elastic material receiving a pressure from the actuator, a second portion of the flow channel wall portion being bent and deformed between the flow channel and the accommodation chamber by receiving a pressure from the elastic material, an area of the second portion being less than an area of the first portion.

According to the liquid ejecting apparatus, since a movement amount of the flow channel wall portion with respect to driving of the actuator can be increased by the displacement amplifying mechanism, the flow channel resistance of the flow channel can be adjusted in a wider range and can be changed in a shorter time. Thus, the pressure of the pressure chamber can be controlled with high accuracy. Further, in the liquid ejecting apparatus, the displacement amplifying mechanism is realized in a simple configuration in which a pressure is transmitted through the elastic material of the accommodation chamber so that a displacement amount of the flow channel wall portion becomes more than a displacement amount of the actuator. With the displacement amplifying mechanism having the configuration, since the number of places where a gear or a joint mechanism configured with a rigid body is used can be reduced, occurrence of mechanical abrasion in the liquid ejecting apparatus is suppressed. Further, when the displacement amplifying mechanism having such a simplified configuration is adopted, the liquid ejecting apparatus can be miniaturized and weight-lightened.

[2] In the liquid ejecting apparatus, the flow channel wall includes a diaphragm that, when the flow channel wall portion is displaced in the first direction, is bent and deformed to generate an elastic force acting in a second direction that is opposite to the first direction.

According to the liquid ejecting apparatus, since the flow channel wall portion is configured with a diaphragm, trackability of the displacement of the flow channel wall portion with respect to repetition of displacement of the actuator can be enhanced by an elastic force generated in the flow channel wall portion. Thus, accuracy of control of liquid discharge in the liquid ejecting apparatus can be enhanced.

[3] In the liquid ejecting apparatus, the displacement amplifying mechanism may further include a sealing wall portion that is disposed between the actuator and the elastic material, seals the accommodation chamber, and is displaced according to the displacement of the actuator.

According to the liquid ejecting apparatus, movement of the elastic material from the accommodation chamber to the actuator is suppressed by the sealing wall portion.

[4] In the liquid ejecting apparatus, the flow channel may include a supply flow channel that supplies the liquid to be supplied to the pressure chamber, and a communication flow channel that communicates with the supply flow channel and the pressure chamber and has an opening end portion that opens the supply flow channel, in which the flow channel wall portion may be provided at a position facing the opening end portion of the communication flow channel in the supply flow channel, may be displaced to close the opening end portion, and may suppress inflow of the liquid into the pressure chamber.

According to the liquid ejecting apparatus, the inflow of the liquid from the supply flow channel to the communication flow channel can be accurately controlled by the flow channel wall portion. Further, as the flow channel wall portion is displaced to close the opening end portion, escaping of the pressure generated to discharge the liquid from the nozzle from the pressure chamber can be more effectively suppressed.

[5] In the liquid ejecting apparatus, an inner peripheral wall surface on the opening end portion side in the communication flow channel may be inclined such that an opening diameter of the communication flow channel increases toward the flow channel wall portion, and when being displaced in a direction in which the cross-sectional area of the flow channel is reduced, the flow channel wall portion comes into contact with the inner peripheral wall surface to seal the communication flow channel.

According to the liquid ejecting apparatus, a sealing property of the pressure chamber can be enhanced by the flow channel wall portion. Further, since the displacement of the flow channel wall portion is guided by the inner peripheral wall surface of the opening end portion, the displacement operation of the flow channel wall portion becomes smoother.

[6] In the liquid ejecting apparatus, the flow channel may include a circulation flow channel that is connected to the supply flow channel on a downstream side of the communication flow channel, and the liquid ejecting apparatus may further include a circulation portion that generates a negative pressure in the circulation flow channel such that the liquid flows into the circulation flow channel, and circulates the liquid flowing into the circulation flow channel to the supply flow channel.

According to the liquid ejecting apparatus, as the liquid circulates, retention of the liquid in the pressure chamber is suppressed. Thus, occurrence of deterioration and defective discharge of the liquid resulting from the retention of the liquid is suppressed. Further, the inflow of the liquid to the communication flow channel can be controlled by the flow channel wall portion, and the inflow of the liquid to the circulation flow channel can be controlled by the flow channel wall portion.

[7] In the liquid ejecting apparatus, the flow channel may include: a supply flow channel that supplies the liquid to the pressure chamber; a communication flow channel that communicates with the supply flow channel and the pressure chamber; a first circulation flow channel which is connected to the supply flow channel on a downstream side of the communication flow channel and into which the liquid flows from the supply flow channel; a second circulation flow channel which is connected to the pressure chamber and into which the liquid in the pressure chamber flows; and a joining circulation flow channel that is connected to the first circulation flow channel and the second circulation flow channel, in which the liquid ejecting apparatus may further include a circulation portion that generates a negative pressure in the joining circulation flow channel such that the liquid flows from the first circulation flow channel and the second circulation flow channel into the joining circulation flow channel, and circulates the liquid flowing into the joining circulation flow channel to the supply flow channel, the first circulation flow channel has a connection opening that opens the joining circulation flow channel, and the flow channel wall portion may be provided to face the connection opening in the joining circulation flow channel and is displaced to close the connection opening.

According to the liquid ejecting apparatus, when the liquid is discharged from the nozzle, as the flow channel wall portion is displaced, escaping of the pressure from the pressure chamber through the second circulation flow channel can be suppressed while a flow rate of the liquid from the communication flow channel to the pressure chamber increases. Thus, the pressure of the liquid in the pressure chamber can be efficiently controlled.

[8] In the liquid ejecting apparatus, the flow channel wall portion may be supported by an elastic support member, and when the actuator is displaced to apply a pressure to the elastic material, the elastic support member may be deformed to generate an elastic force acting in a direction from the flow channel to the accommodation chamber, and moves a position of the flow channel wall portion in a direction in which a cross-sectional area of the flow channel is reduced.

According to the liquid ejecting apparatus, an elastic force in an opposite direction, which is generated when the flow channel wall portion is displaced in a direction in which the cross-sectional area of the flow channel is reduced is easily generated by the elastic support member.

[9] In the liquid ejecting apparatus, a filler having a compression ratio that is less than that of the elastic material may be dispersed inside the elastic material.

According to the liquid ejecting apparatus, since compression of the elastic material can be suppressed by the filler, absorption of a driving force of the actuator by the compression of the elastic material can be suppressed. Thus, in the displacement amplifying mechanism, transmission efficiency of the pressure from the actuator to the flow channel wall portion can be enhanced and control accuracy of the flow channel resistance can be enhanced.

[10] The liquid ejecting apparatus may further include an adjustment portion that adjusts an initial position of the flow channel wall portion before the actuator is pressed toward the elastic material to be driven.

According to the liquid ejecting apparatus, since displacement characteristics of the displacement amplifying mechanism can be adjusted by the adjustment portion, the control accuracy of the flow channel resistance of the flow channel can be enhanced.

All of a plurality of constituent elements of the above-described embodiments of the invention are not essential. In order to solve some or all of the above-described problems or achieve some or all of the effects described in the specification, in an appropriate manner, some of the plurality of constituent elements can be changed, removed, and replaced with other novel constituent elements, and some of delimited contents thereof can be deleted. Further, in order to solve some or all of the above-described problems or achieve some or all of the effects described in the specification, some or all of the above-described technical features included in one embodiment of the invention are combined with some or all of the above-described technical features included in another embodiment of the invention so that one independent embodiment can be formed.

The invention can be realized various forms in addition to the liquid ejecting apparatus. For example, the invention can be realized in various forms such as a head portion that discharges a liquid, a control device that controls a flow channel resistance of a flow channel, a method of controlling a pressure of a pressure chamber in the head portion, a method of controlling a flow channel resistance of the flow channel, and an displacement amplifying mechanism used in an actuator that controls the flow channel resistance of the flow channel.

BRIEF DESCRIPTION OF THE DRAWINGS

The invention will be described with reference to the accompanying drawings, wherein like numbers reference like elements.

DESCRIPTION OF EXEMPLARY EMBODIMENTS

1. First Embodiment

Figure 1:
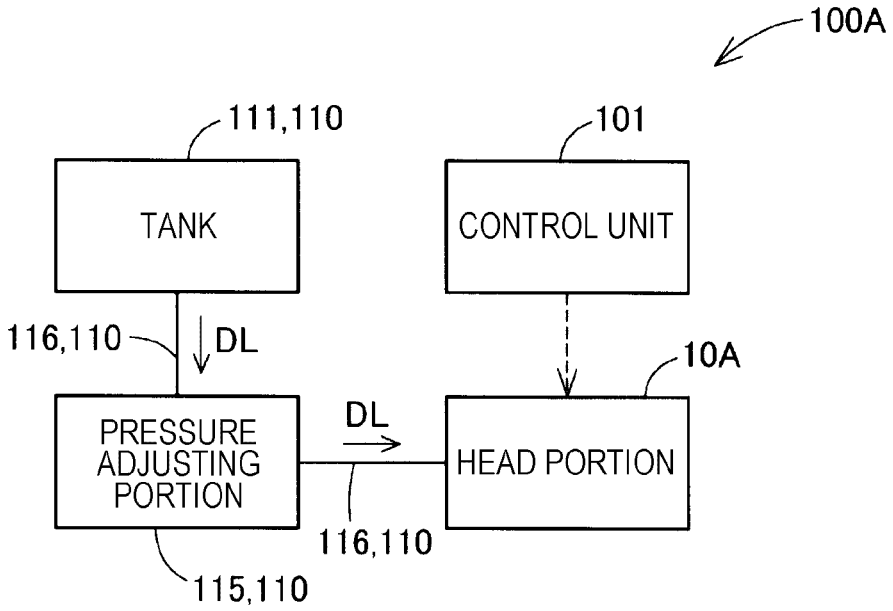
FIG. 1 is a schematic block diagram illustrating the overall configuration of a liquid ejecting apparatus according to a first embodiment.

FIG. 1 is a schematic block diagram illustrating the overall configuration of a liquid ejecting apparatus 100A according to a first embodiment. The liquid ejecting apparatus 100A includes a head portion 10A, a control unit 101, and a supply portion 110.

The head portion 10A discharges a liquid DL toward a medium. The liquid DL is, for example, an ink having a predetermined viscosity. An operation of the head portion 10A is controlled by the control unit 101. A configuration of the head portion 10A will be described below.

The control unit 101 is configured as a computer including a CPU and a memory and realizes various functions for controlling the liquid ejecting apparatus 100A as the CPU reads and executes a control program and an instruction stored in the memory. The control program may be stored in non-temporary various recording media. The control unit 101 may be configured with a circuit.

The supply portion 110 supplies the liquid DL to the head portion 10A. The supply portion 110 includes a tank 111, a pressure adjusting portion 115, and a supply channel 116. The liquid DL is accommodated in the tank 111. The liquid DL in the tank 111 is supplied to the head portion 10A through the supply channel 116 connected to the head portion 10A.

The pressure adjusting portion 115 is provided in the supply channel 116 and adjusts the pressure of the liquid DL supplied to the head portion 10A through the supply channel 116 to a predetermined pressure. The pressure adjusting portion 115 is configured with a pump that suctions the liquid DL from the tank 111, a valve that is opened/closed such that the pressure on the head portion 10A side becomes the predetermined pressure, and the like (not illustrated).

Figure 2:
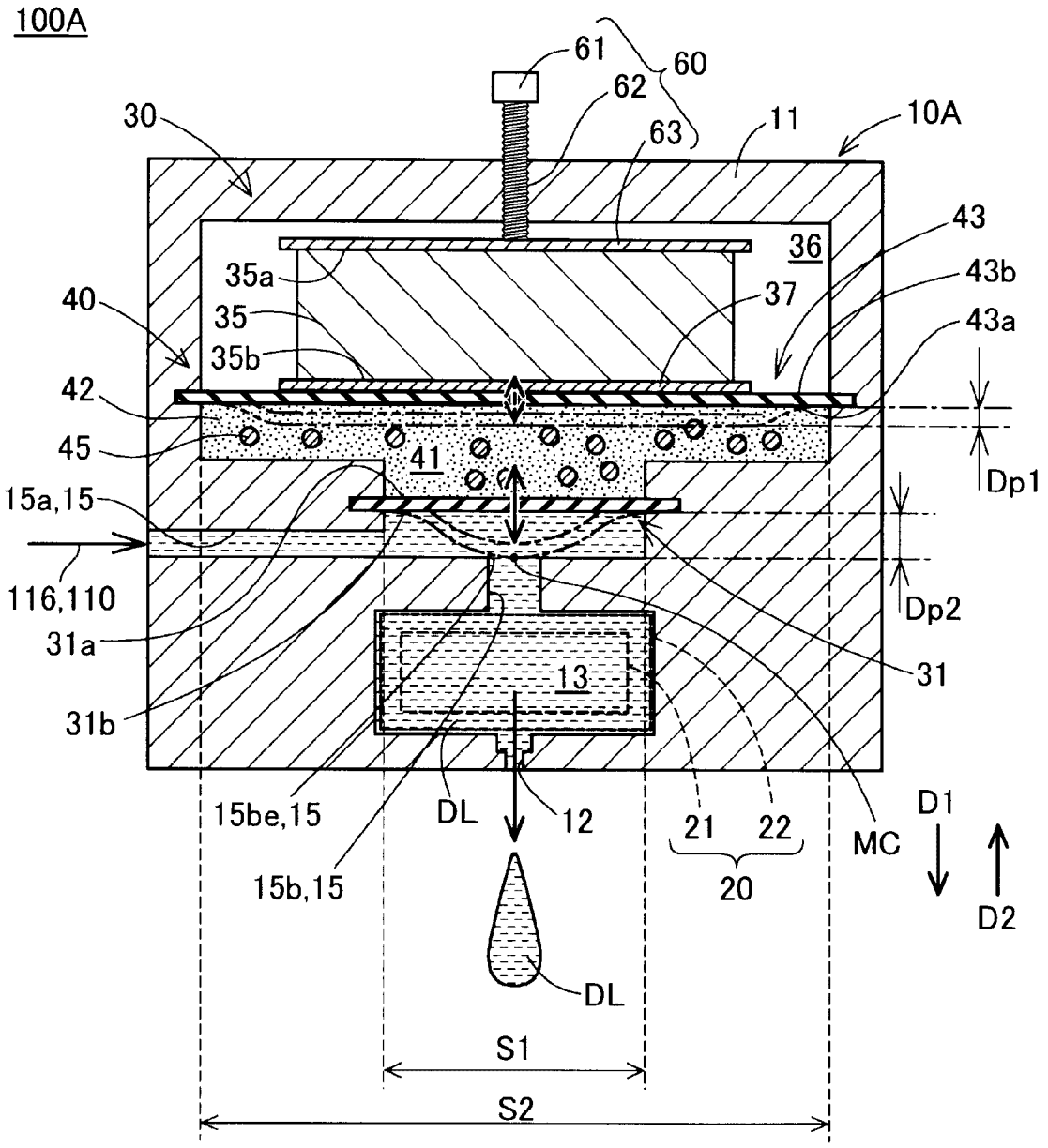
FIG. 2 is a schematic cross-sectional view schematically illustrating a configuration of a head portion of the first embodiment.

FIG. 2 is a schematic cross-sectional view schematically illustrating a configuration of a head portion 10A of the first embodiment. FIG. 2 illustrates a cut surface passing through a central axis of a nozzle 12, a flow channel 15, and a pressure chamber 13. In the cross-sectional views of the other embodiments described after the first embodiment, the same cut surface is illustrated unless otherwise mentioned.

The head portion 10A of the first embodiment includes a housing 11 formed of metal, and the nozzle 12, the pressure chamber 13, and the flow channel 15 are provided inside the housing 11. The nozzle 12 is provided as a through-hole that communicates with the pressure chamber 13 and is opened toward the outside of the housing 11. In the first embodiment, the nozzle 12 is opened in the gravity direction such that the head portion 10A discharges the liquid DL in the gravity direction. The nozzle 12 may be provided to be opened in directions other than the gravity direction.

The pressure chamber 13 accommodates the liquid DL discharged from the nozzle 12. The flow channel 15 through which the liquid DL flows is connected to the pressure chamber 13. In the first embodiment, the flow channel 15 includes a supply flow channel 15*a* and a communication flow channel 15*b*. The supply flow channel 15*a* is connected to the supply channel 116 of the supply portion 110. The supply flow channel 15*a* extends from a connection portion of the supply channel 116 provided in the housing 11 toward the pressure chamber 13. The communication flow channel 15*b* communicates with the supply flow channel 15*a* and the pressure chamber 13. The flow channel 15 includes an opening end portion 15*be* of the communication flow channel 15*b* which is opened in the supply flow channel 15*a*. In the first embodiment, the supply flow channel 15*a* extends upward from the pressure chamber 13, and the communication flow channel 15*b* is connected to the pressure chamber 13 extending downward from the supply flow channel 15*a*.

The liquid DL is supplied to the pressure chamber 13 through the supply flow channel 15*a* and the communication flow channel 15*b*. The pressure of the supply flow channel 15*a* is adjusted to a pressure that is equal to or more than the meniscus withstand pressure of the nozzle 12 by the pressure adjusting portion 115 (FIG. 1) of the supply portion 110. Further, the pressure of the pressure chamber 13 is generally adjusted to a pressure that is less than the meniscus withstand pressure of the nozzle 12 by a flow channel resistance changing portion 30 which is provided between the supply flow channel 15*a* and the communication flow channel 15*b* and will be described below.

A pressure generating portion 20 is further provided in the head portion 10A. The pressure generating portion 20 generates a discharge pressure which is a pressure for discharging the liquid DL from the nozzle 12 to the pressure chamber 13 under a control of the control unit 101 (FIG. 1). In the first embodiment, the pressure generating portion 20 is provided at a position that is adjacent to the pressure chamber 13 in a horizontal direction. In FIG. 2, for the sake of convenience, the pressure generating portion 20 is illustrated by a broken line.

In the first embodiment, the pressure generating portion 20 includes a diaphragm 21 and a discharge actuator 22 that is connected to the diaphragm 21. The diaphragm 21 constitutes a part of a wall surface of the pressure chamber 13. In the first embodiment, the diaphragm 21 constitutes a side wall surface oriented in a horizontal direction. The diaphragm 21 is bent, deformed, and displaced to change the volume of the pressure chamber 13 so as to generate the discharge pressure in the pressure chamber 13. The discharge actuator 22 generates displacement for bending and deforming the diaphragm 21 under the control of the control unit 101 (FIG. 1). The discharge actuator 22 is configured with, for example, a piezoelectric element (a piezo element) that is expanded and contracted according to an applied voltage.

The head portion 10A further includes the flow channel resistance changing portion 30. The flow channel resistance changing portion 30 controls transmission of pressure between the pressure chamber 13 and the flow channel 15 by changing the flow channel resistance of the flow channel 15 under the control of the control unit 101 (FIG. 1). The flow channel resistance changing portion 30 includes a flow channel wall portion 31, an actuator 35, and an displacement amplifying mechanism 40.

The flow channel wall portion 31 constitutes a part of a wall surface of the flow channel 15 and is displaced to change the cross-sectional area of a part of the flow channel 15 so as to change the flow channel resistance of the flow channel 15. The flow channel wall portion 31 is displaced to change the cross-sectional area of a region facing the flow channel wall portion 31 in the flow channel 15. In the specification, the "cross-sectional area" of a flow channel means the area of an opening region in a cross section that is perpendicular to a flow direction of liquid in the flow channel.

In the first embodiment, the flow channel wall portion 31 constitutes a part of a wall surface of the supply flow channel 15*a* and is provided at a position facing the opening end portion 15*be* of the communication flow channel 15*b*. Accordingly, inflow of the liquid DL from the supply flow channel 15*a* to the communication flow channel 15*b* can be accurately controlled by the flow channel wall portion 31.

In the first embodiment, the flow channel wall portion 31 is configured as a diaphragm and is configured with a film-shaped member of which the outer peripheral end portion is fixed to the housing 11. The flow channel wall portion 31 is bent and deformed to be displaced in a thickness direction as illustrated by a one-dot chain line according to a change in pressure applied in the thickness direction. In the first embodiment, the flow channel wall portion 31 is displaced to close the opening end portion 15*be* of the communication flow channel 15*b*.

In the first embodiment, the flow channel wall portion 31 is in contact with the inner peripheral end portion of the opening end portion 15*be* and is configured to be displaced until connection between the supply flow channel 15*a* and the pressure chamber 13 is blocked. In the specification, a state in which a flow channel is closed and flow of liquid is blocked is interpreted as a state in which a flow channel resistance of the flow channel is maximized.

The flow channel wall portion 31 is configured with a member which generates an elastic force as a restoring force when being bent and deformed. In the first embodiment, the flow channel wall portion 31 is configured with a film-shaped member formed of rubber. The flow channel wall portion 31 may not be configured with a member formed of rubber, may be configured with another resin member, and may be formed of metal.

It is preferable that the flow channel wall portion 31 have a substantially uniform thickness to suppress occurrence of stress concentration when being bent and deformed. Here, in the displacement amplifying mechanism 40, when pressure is applied from the actuator 35 through an elastic material 42 to the surface of the flow channel wall portion 31 in a first direction D1 from an accommodation chamber 41 to the flow channel 15, a part of the flow channel wall portion 31, which protrudes most toward the flow channel 15, is defined as a "deformation center portion MC of the flow channel wall portion 31". Further, in the flow channel wall portion 31 in a flat state in which the flow channel wall portion 31 is not bent and deformed, a length of a line segment having the minimum length among line segments connecting opposite ends of a region passing through the above-described deformation center portion MC and facing the liquid DL of the flow channel 15 in the flow channel wall portion 31 is called a "minimum width of a bending deformation portion". At this time, it is preferable that the thickness of the flow channel wall portion 31 in the flat state be less than the minimum width of the bending deformation portion. Accordingly, the flow channel wall portion 31 can be easily bent and deformed, and trackability of displacement of the flow channel wall portion 31 with respect to displacement of the elastic material 42 can be enhanced.

Here, it is considered that a pressure which the flow channel wall portion 31 receives through the elastic material 42 is uniformly transmitted to the surface of the flow channel wall portion 31. Thus, when the outer peripheral shape of the portion of the flow channel wall portion 31, facing the flow channel 15 in the flow channel wall portion 31, is a circular shape, the deformation center portion MC of the flow channel wall portion 31 is interpreted as a center of the circular shape. In this case, the minimum width of the bending deformation portion can be interpreted as the diameter of the circular shape. Further, similarly, when the outer peripheral shape of the portion of the flow channel wall portion 31, facing the flow channel 15, is a square shape or a rectangular shape, the deformation center portion MC of the flow channel wall portion 31 is interpreted as a center of the square shape or the rectangular shape. In this case, the minimum width of the bending deformation portion can be interpreted as the length of one side of the square shape or the length of the short side of the rectangular shape.

The actuator 35 is driven to displace the flow channel wall portion 31 under the control of the control unit 101 (FIG. 1). The actuator 35 is accommodated in a driving chamber 36 which is a space provided inside the housing 11. In the first embodiment, the actuator 35 is configured with a piezo element that is expanded and contracted according to the applied voltage. A first end portion 35*a* of the actuator 35 in an expansion/contraction direction is fixed to the housing 11 through an adjustment portion 60. The adjustment portion 60 will be described below.

When the actuator 35 is expanded and contracted, a position of a second end portion 35*b* that is opposite to the first end portion 35*a* is moved. The displacement amount of the actuator 35 is a movement distance of the second end portion 35*b* caused by the expansion/contraction of the actuator 35. The second end portion 35*b* of the actuator 35 is connected to the displacement amplifying mechanism 40 through a connection portion 37.

The displacement generated by the actuator 35 is transmitted to the flow channel wall portion 31 through the displacement amplifying mechanism 40. The displacement amplifying mechanism 40 is provided between the actuator 35 and the flow channel wall portion 31 and increases the displacement amount of the flow channel wall portion 31 more than the displacement amount of the actuator 35. The displacement amplifying mechanism 40 includes the accommodation chamber 41, the elastic material 42, and a sealing wall portion 43.

The accommodation chamber 41 is configured as a hollow portion provided inside the housing 11 and is sealed by the sealing wall portion 43 and the flow channel wall portion 31. In the housing 11, the accommodation chamber 41 and the driving chamber 36 are partitioned by the sealing wall portion 43 and the accommodation chamber 41 and the flow channel 15 are partitioned by the flow channel wall portion 31.

The elastic material 42 is accommodated in the accommodation chamber 41. The elastic material 42 is elastically deformed by the displacement of the actuator 35. In the first embodiment, the elastic material 42 receives a pressure from the actuator 35 through the sealing wall portion 43. The elastic material 42 is formed of a material which exhibits a fluidic property that can transmit pressure in all directions, which is like liquid. It is preferable that the fluidity shown when the elastic material 42 receives a pressure from the outside to be deformed be higher. The elastic material 42 is formed of various rubber materials including, for example, silicone rubber. The elastic material 42 may be formed by, for example, vacuum casting.

It is preferable that the accommodation chamber 41 be filled with the elastic material 42 such that almost no gap is formed on the side wall surface of the accommodation chamber 41. Accordingly, when the elastic material 42 is pressed by the actuator 35, deformation of the elastic material 42 in a direction (a horizontal direction in the present embodiment) intersecting a direction in which an external force is applied by the actuator 35 is suppressed by the side wall surface of the accommodation chamber 41. It is preferable that the elastic material 42 be joined to the flow channel wall portion 31 through adhesive, welding, fusing, or the like to enhance trackability of the displacement amplifying mechanism 40 with respect to the displacement of the actuator 35.

A first wall surface 43*a* of the sealing wall portion 43 faces the elastic material 42 of the accommodation chamber 41 and constitutes a part of a wall surface of the accommodation chamber 41. A second wall surface 43*b* that is opposite to the first wall surface 43*a* is connected to the second end portion 35*b* of the actuator 35 through the connection portion 37. An outer peripheral end of the sealing wall portion 43 is fixed to the housing 11. The sealing wall portion 43 is operated as a diaphragm that is bent and deformed in a thickness direction with respect to the displacement of the actuator 35, as indicated by a two-dot chain line.

In the first embodiment, the sealing wall portion 43 is formed of a rubber film-shaped member. The sealing wall portion 43 may not be formed of a rubber member. The sealing wall portion 43 may be formed of another resin member or may be formed of a metal plate. In the displacement amplifying mechanism 40, as the accommodation chamber 41 is sealed by the sealing wall portion 43, when the actuator 35 presses the elastic material 42, movement of the elastic material 42 from the accommodation chamber 41 to the actuator 35 is suppressed.

The flow channel wall portion 31 includes a first wall surface 31*a* facing the elastic material 42 of the accommodation chamber 41 and a second wall surface 31*b* facing the liquid DL of the flow channel 15. When the actuator 35 is displaced to apply a pressure to the elastic material 42 of the accommodation chamber 41, the flow channel wall portion 31 is displaced in the first direction D1 that is a direction away from the accommodation chamber 41, to reduce a flow channel cross-sectional area of the flow channel 15.

Since the flow channel wall portion 31 of the first embodiment is configured with a diaphragm, when the flow channel wall portion 31 is displaced in the first direction D1 in which the flow channel cross-sectional area of the flow channel 15 is reduced, the flow channel wall portion 31 is displaced in a state in which an elastic force acting in a second direction D2 that is opposite to the first direction D1 is generated. The first direction D1 is a direction along a thickness direction of the flow channel wall portion 31 and is a direction from the accommodation chamber 41 to the flow channel wall portion 31. In the first embodiment, the elastic force generated by the displacement of the flow channel wall portion 31 and acting in the second direction D2 is generated as a restoring force against the bending and deforming of the flow channel wall portion 31.

In the displacement amplifying mechanism 40, an area S1 of a portion of the flow channel wall portion 31 to be bent and deformed between the flow channel 15 and the accommodation chamber 41 by receiving a pressure from the elastic material 42, is less than an area S2 of a portion of the elastic material 42 receiving a pressure from the actuator 35 (S1<S2). The area S2 is an area of a region obtained by projecting a portion of the elastic material 42, deformed by the displacement of the actuator 35, onto a virtual plane that is perpendicular to the displacement direction of the actuator 35 in the displacement direction. In the first embodiment, the area S2 corresponds to an area of a region obtained by projecting a portion of the sealing wall portion 43, bent and deformed by the displacement of the actuator 35, onto a virtual plane that is perpendicular to the displacement direction of the actuator 35 in the displacement direction. The area S1 is an area of a region obtained by projecting a portion of the flow channel wall portion 31, facing the elastic material 42, onto a virtual plane that is perpendicular to the displacement direction of the flow channel wall portion 31 in the displacement direction. The area S1 can be interpreted as an area of a region of the flow channel wall portion 31, bending and deforming of which is permitted, and as an area of an opening portion which communicates with the flow channel 15 and the accommodation chamber 41 and is closed by the flow channel wall portion 31.

In the displacement amplifying mechanism 40, as described above, a difference is provided between the area S2 of the portion of the elastic material 42 receiving the pressure from the actuator 35, and the area S1 of the portion of the flow channel wall portion 31 to be bent and deformed. When receiving the pressure by the displacement of the actuator 35, the elastic material 42 exhibits fluidic behavior and is deformed to flow. The pressure generated by the displacement of the actuator 35 is transmitted to the flow channel wall portion 31 due to fluidity expressed in the elastic material 42. At this time, according to the Pascal's principle, a displacement amount Dp2 of the flow channel wall portion 31 becomes more than a displacement amount Dp1 of the sealing wall portion 43 which is equal to a displacement amount of the actuator 35, due to the difference between the areas S1 and S2.

As the displacement amount of the flow channel wall portion 31 is enlarged, the flow channel resistance of the supply flow channel 15*a* can be adjusted in a wide range. Further, the displacement speed of the flow channel wall portion 31 is increased with respect to an expansion/contraction speed of the actuator 35. Therefore, occurrence of response delay of the flow channel wall portion 31 is suppressed, and the flow channel resistance of the supply flow channel 15*a* can be changed at a more appropriate timing. Therefore, even when the actuator 35 having a small expansion/contraction amount is adopted, a decrease in the displacement range of the accommodation chamber 41 can be suppressed, so that power consumption of the actuator 35 can be reduced, and the actuator 35 can be miniaturized.

According to the displacement amplifying mechanism 40, as described above, when the actuator 35 is expanded, the flow channel wall portion 31 is displaced to a state in which an elastic force is generated in the second direction D2. Therefore, the displacement of the flow channel wall portion 31 in the second direction D2 when the actuator 35 is contracted is assisted by the elastic force. Accordingly, even when the displacement of the flow channel wall portion 31 is repeated at a high speed, delay of a timing of the displacement of the flow channel wall portion 31 with respect to a driving timing of the actuator 35 is suppressed.

In the head portion 10A, the flow channel wall portion 31 constitutes a wall portion of the flow channel 15 and also constitutes a wall portion of the accommodation chamber 41 of the displacement amplifying mechanism 40. The head portion 10A is compactly configured.

In the displacement amplifying mechanism 40, a filler 45 is dispersed in the elastic material 42 of the accommodation chamber 41. The filler 45 is a member made of a material having a compression ratio that is less than that of the elastic material 42 in the form of fine particles. The "compression ratio" is a value representing a change rate of a volume before and after an external force is applied. The smaller the compression ratio is, the smaller the degree of a reduction in the volume when the external force is applied is. The filler 45 may be formed of a material having hardness that is higher than that of the elastic material 42. The filler 45 is formed of, for example, metal, resin, ceramics, glass, or the like. Absorption of the pressure applied from the actuator 35 by compression of the volume of the elastic material 42 is suppressed by the filler 45. Therefore, transmission efficiency of the pressure from the sealing wall portion 43 via the accommodation chamber 41 to the flow channel wall portion 31 is enhanced and responsiveness of the displacement amplifying mechanism 40 to the displacement of the actuator 35 is enhanced. The filler 45 may be omitted.

The displacement amplifying mechanism 40 further includes an adjustment portion 60. The adjustment portion 60 is provided on the first end portion 35*a* side of the actuator 35. The adjustment portion 60 is configured with an adjustment screw 61, a screw hole 62 provided in the housing 11, and a pressing plate 63. The adjustment screw 61 is inserted through the screw hole 62 passing through the housing 11 toward the first end portion 35*a* of the actuator 35. The adjustment screw 61 is fitted in the screw hole 62 such that a tip end portion of the adjustment screw 61 presses the first end portion 35*a* of the actuator 35 through the pressing plate 63.

In the displacement amplifying mechanism 40, an installation position of the actuator 35 with respect to the accommodation chamber 41 can be changed by rotating an adjustment screw 61 of the adjustment portion 60 and increasing/decreasing the length of the adjustment screw 61 protruding from the driving chamber 36 toward the actuator 35. When the position of the actuator 35 is changed by the adjustment screw 61, a displacement position of the sealing wall portion 43 is changed from an initial state when the actuator 35 is not driven toward the accommodation chamber 41. Further, a displacement position of the flow channel wall portion 31 in the first direction D1 in the initial state and the pressure applied to the elastic material 42 in the initial state are changed. In this way, displacement characteristics of the displacement amplifying mechanism 40 can be adjusted by adjusting an initial position of the flow channel wall portion 31 by the adjustment portion 60. The adjustment portion 60 may be omitted.

In the liquid ejecting apparatus 100A, the control unit 101 (FIG. 1) controls the flow channel resistance changing portion 30, for example, as follows. When the liquid DL is discharged from the nozzle 12, first, the control unit 101 displaces the flow channel wall portion 31 to a position that is furthest from the opening end portion 15*be* of the communication flow channel 15*b* by the flow channel resistance changing portion 30, to minimize the flow channel resistance of the supply flow channel 15*a*. Accordingly, the pressure chamber 13 is rapidly filled with the liquid DL through the supply flow channel 15*a*. At this time, it is preferable that the control unit 101 control the flow channel resistance changing portion 30 to adjust the pressure in the pressure chamber 13 to a pressure that is equal to or less than the meniscus withstand pressure of the nozzle 12.

Next, the control unit 101 drives the discharge actuator 22, instantaneously reduces the volume of the pressure chamber 13, and generates the discharge pressure inside the pressure chamber 13, which is more than the meniscus withstand pressure of the nozzle 12. At this time, the control unit 101 increases the flow channel resistance of the supply flow channel 15*a* by displacing the flow channel wall portion 31 in the first direction D1 according to a generation timing of the discharge pressure. The control unit 101 may close the opening end portion 15*be* by the flow channel wall portion 31 to block connection between the supply flow channel 15*a* and the pressure chamber 13. Accordingly, since escaping of the discharge pressure generated inside the pressure chamber 13 to the supply flow channel 15*a* is suppressed, discharge efficiency of the liquid DL by the head portion 10A can be enhanced.

In particular, in the first embodiment, since the flow channel wall portion 31 is provided at a position facing the opening end portion 15*be*, the liquid DL can be forcibly introduced into the communication flow channel 15*b* by displacing the flow channel wall portion 31 in the first direction D1. Thus, as the flow channel wall portion 31 is displaced in the first direction D1 according to the generation timing of the discharge pressure, an increase in the pressure inside the pressure chamber 13 can be assisted and discharge efficiency of the liquid DL by the head portion 10A is further enhanced.

After starting discharge of the liquid DL from the nozzle 12, the control unit 101 contracts the discharge actuator 22, displaces the diaphragm 21, and increases the volume of the pressure chamber 13. Accordingly, a negative pressure is generated in the pressure chamber 13 to pull back the liquid DL of the nozzle 12 toward the pressure chamber 13, so that separation of liquid droplets of the liquid DL from the nozzle 12 and flying of the liquid droplets can be promoted.

The control unit 101 displaces the flow channel wall portion 31 in the second direction D2 in a direction in which the flow channel resistance of the supply flow channel 15*a* is reduced according to a generation timing of the negative pressure. The liquid DL of the pressure chamber 13 flows to a region where the volume of the supply flow channel 15*a* is enlarged by the displacement of the flow channel wall portion 31 through the communication flow channel 15*b*, so that the pressure of the pressure chamber 13 can be reduced in a shorter time. Accordingly, the liquid droplets of the liquid DL can be more certainly separated from the nozzle 12, and a flight state of the liquid droplets can be improved.

In particular, in the first embodiment, since the flow channel wall portion 31 is provided at a position facing the opening end portion 15*be*, a negative pressure is easily generated in the communication flow channel 15*b* by displacing the flow channel wall portion 31 in the second direction D2. Thus, as the flow channel wall portion 31 is displaced in the second direction D2 according to the generation timing of the discharge pressure, generation efficiency of the negative pressure inside the pressure chamber 13 can be further enhanced and the liquid droplets can be more satisfactorily separated from the nozzle 12.

In addition, for example, when the head portion 10A enters a standby state in which the liquid DL is not discharged for a predetermined period, the control unit 101 may increase the flow channel resistance of the supply flow channel 15*a* by displacing the flow channel wall portion 31 in the first direction D1. The control unit 101 may close the opening end portion 15*be* of the communication flow channel 15*b* by the flow channel wall portion 31. Accordingly, leakage of the liquid DL from the nozzle 12 during the standby state of the head portion 10A can be suppressed.

Figure 3:
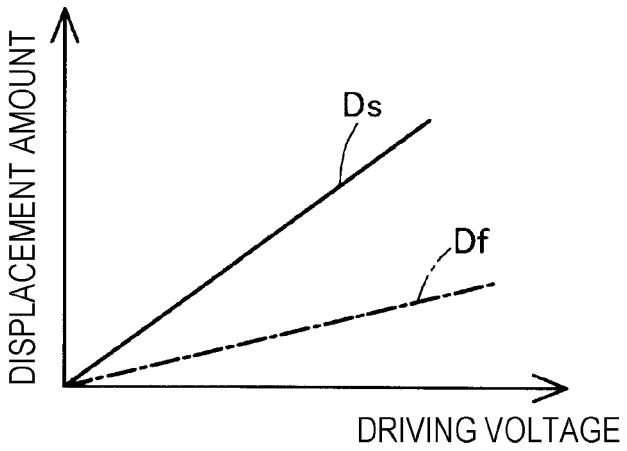
FIG. 3 is a first view illustrating operation characteristics of an displacement amplifying mechanism of the first embodiment.

Operation characteristics of the displacement amplifying mechanism 40, which are verified by an experiment of the inventor of the invention, will be described with reference to FIGS. 3 and 4. FIG. 3 illustrates graphs Ds and Df depicting changes in displacement amounts of the sealing wall portion 43 and the flow channel wall portion 31 with respect to a driving voltage applied to the actuator 35. The graph Df indicated by a one-dot chain line illustrates the displacement amount of the sealing wall portion 43 and the graph Ds indicated by a solid line illustrates the displacement amount of the flow channel wall portion 31. It is identified by the displacement amplifying mechanism 40 that the displacement amounts of the wall portions 43 and 31 linearly increase as the driving voltage increases. Further, it is identified that the displacement amount of the flow channel wall portion 31 is more than the displacement amount of the sealing wall portion 43 according to a difference between the areas S1 and S2 (FIG. 2) according to the same driving voltage.

Figure 4:
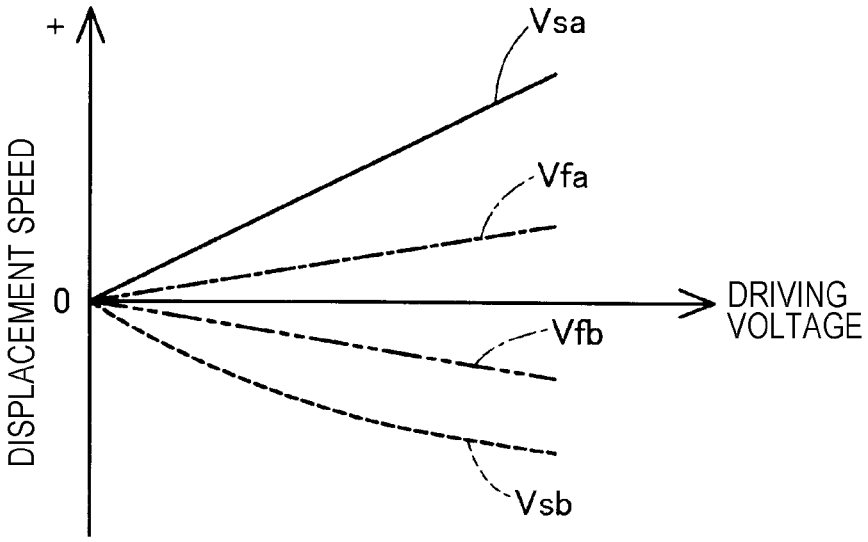
FIG. 4 is a second view illustrating the operation characteristics of the displacement amplifying mechanism of the first embodiment.

FIG. 4 illustrates graphs depicting changes in displacement speeds of the sealing wall portion 43 and the flow channel wall portion 31 with respect to the driving voltage applied to the actuator 35. In the graphs of FIG. 4, a displacement speed when the flow channel wall portion 31 is displaced in the first direction D1 (FIG. 2) is positive (+) and a displacement speed when the flow channel wall portion 31 is displaced in the second direction D2 (FIG. 2) is negative (−). A graph Vfa indicated by a one-dot chain line and a graph Vfb indicated by a two-dot chain line illustrate displacement speeds of the sealing wall portion 43 and a graph Vsa indicated by a solid line and a graph Vsb indicated by a broken line illustrate displacement speeds of the flow channel wall portion 31. It is identified in the displacement amplifying mechanism 40 that the displacement speed when the flow channel wall portion 31 is displaced in the first direction D1 is more than the displacement speeds of the sealing wall portion 43 according to the difference between the areas S1 and S2 (FIG. 2), which is like the displacement amounts. Further, it is identified that the displacement speed when the flow channel wall portion 31 is displaced in the second direction D2 is also more than the displacement speeds of the sealing wall portion 43 at substantially the same rate as that when the flow channel wall portion 31 is displaced in the first direction D1.

As described above, according to the liquid ejecting apparatus 100A of the first embodiment, in the flow channel resistance changing portion 30, the displacement amount of the flow channel wall portion 31 with respect to a range of the displacement amount of the actuator 35 is enlarged by the displacement amplifying mechanism 40. Thus, the flow channel resistance of the flow channel 15 can be adjusted in a wide range. Further, the displacement speed of the flow channel wall portion 31 can be increased with respect to the expansion/contraction speed of the actuator 35, so that occurrence of the response delay of the flow channel wall portion 31 can be suppressed and the flow channel resistance of the flow channel 15 can be changed at a more appropriate timing. Thus, the flow channel resistance of the flow channel 15 by the flow channel resistance changing portion 30 and the pressure of the pressure chamber 13 connected to the flow channel 15 can be controlled at high accuracy and accuracy of the ejection of the liquid DL can be enhanced. Further, by adopting the actuator 35 having a small expansion/contraction amount, power consumption of the head portion 10A can be reduced and the head portion 10A can be downsized.

According to the liquid ejecting apparatus 100A of the first embodiment, by the displacement amplifying mechanism 40 having a simple configuration using the Pascal's principle, complication and enlargement of the apparatus are suppressed and accuracy of the flow channel resistance of the flow channel 15 is enhanced. According to the displacement amplifying mechanism 40 of the liquid ejecting apparatus 100A of the first embodiment, occurrence of mechanical abrasion when the actuator 35 is repeatedly displaced is suppressed as compared to a mechanical configuration that transmits pressure by a rigid joint mechanism using a lever or the like and a gear. Further, miniaturization and weight lightening of the liquid ejecting apparatus 100A can be achieved by simplifying a configuration of the displacement amplifying mechanism 40.

In the liquid ejecting apparatus 100A of the first embodiment, since the elastic material 42 is supported by the flow channel wall portion 31, even when the displacement of the actuator 35 is repeatedly increased and decreased, movement of the elastic material 42 to the pressure chamber 13 is suppressed. Further, in the displacement amplifying mechanism 40, the elastic material 42 is used as a pressure transmitting medium. Therefore, even when the actuator 35 is displaced at a high speed, generation (cavitation) of air bubbles in the pressure transmitting medium, which occurs in a configuration in which liquid is used as the pressure transmitting medium, is suppressed. Thus, performance degradation of the displacement amplifying mechanism 40 can be suppressed by the cavitation and the head portion 10A can be stably driven. Further, according to the displacement amplifying mechanism 40, since the elastic material 42 is used as the pressure transmitting medium, occurrence of evaporation and leakage of the liquid, which occur in the configuration in which the liquid is used as the pressure transmitting medium, is suppressed.

According to the liquid ejecting apparatus 100A of the first embodiment, as follows, a manufacturing process thereof can be facilitated and manufacturing costs can be reduced. As the elastic material 42 is used as the pressure transmitting medium of the displacement amplifying mechanism 40, transportation and installation of the elastic material 42 in the manufacturing process is easy as compared to a case where the liquid is used as the pressure transmitting medium. Further, when the displacement amplifying mechanism 40 is assembled, incorrect entry of a part of the elastic material 42 into the pressure chamber 13 can be suppressed by the flow channel wall portion 31.

According to the liquid ejecting apparatus 100A of the first embodiment, as described above, as the flow channel wall portion 31 is displaced in the first direction D1 in a state in which an elastic force is generated in the second direction D2, responsiveness of the flow channel wall portion 31 is enhanced. This effect can be particularly remarkably obtained when the actuator 35 is repeatedly expanded/contracted at a high speed. In addition, according to the liquid ejecting apparatus 100A of the first embodiment, the various effect described in the first embodiment can be achieved.

2. Second Embodiment

Figure 5:
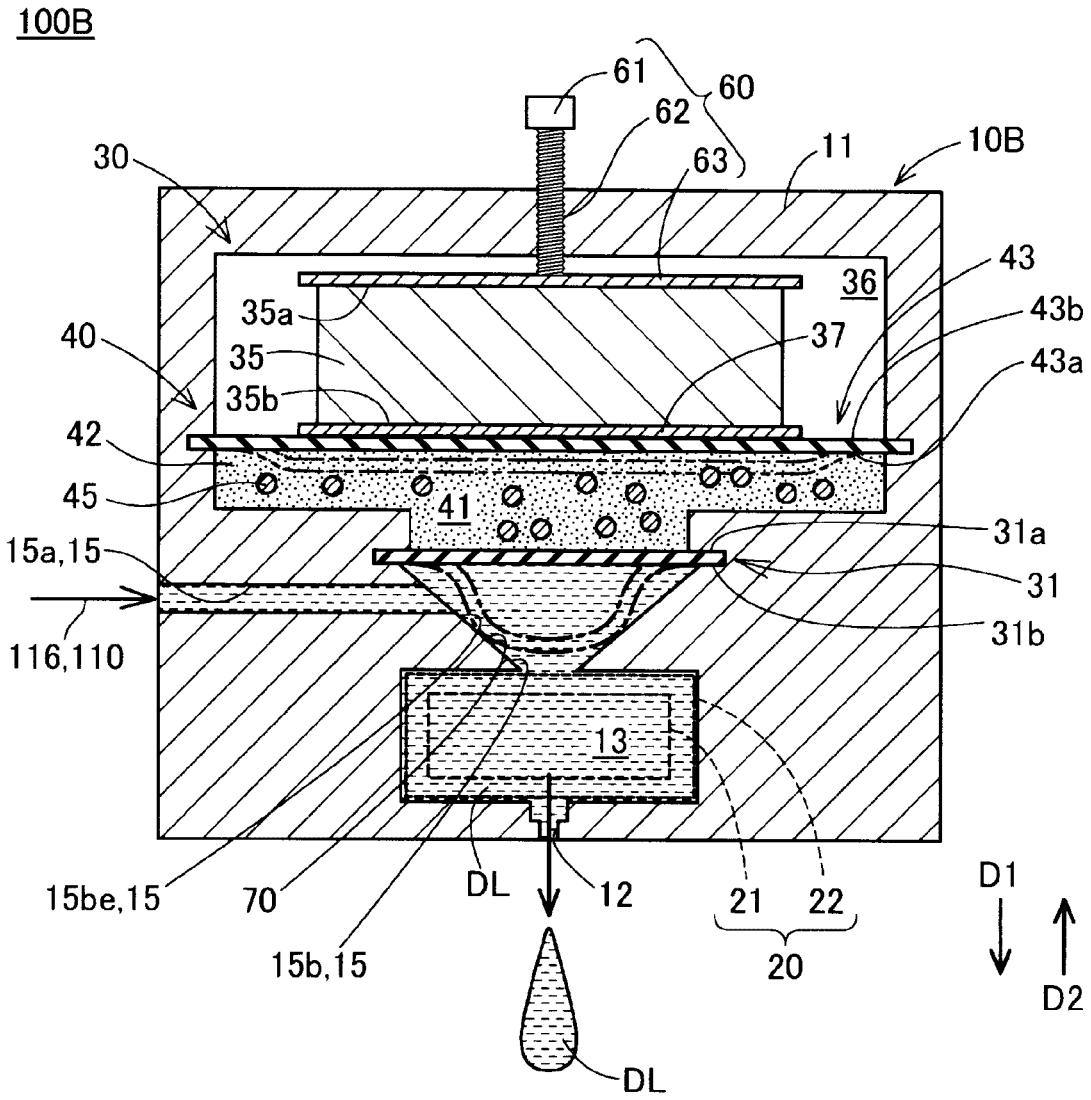
FIG. 5 is a schematic cross-sectional view schematically illustrating a configuration of a head portion of a second embodiment.

FIG. 5 is a schematic cross-sectional view schematically illustrating a configuration of a head portion 10B included in a liquid ejecting apparatus 100B of a second embodiment. A configuration of the liquid ejecting apparatus 100B of the second embodiment is substantially the same as the configuration of the liquid ejecting apparatus 100A (FIG. 1) of the first embodiment except that the head portion 10B of the second embodiment is provided instead of the head portion 10A of the first embodiment. The configuration of the head portion 10B of the second embodiment is substantially the same as the configuration of the head portion 10A (FIG. 2) of the first embodiment except that the communication flow channel 15*b* has an inclined wall surface 70.

In the head portion 10B, an inner peripheral wall surface of the communication flow channel 15*b* constitutes the inclined wall surface 70 inclined in a tapered shape such that an opening diameter thereof increases toward the flow channel wall portion 31 at least on the opening end portion 15*be* side. In the head portion 10B, as illustrated, the entire inner peripheral wall surface of the communication flow channel 15*b* may constitute the inclined wall surface 70. In the head portion 10B, when being displaced in the first direction D1, the flow channel wall portion 31 can come into contact with the inclined wall surface 70 to seal the communication flow channel 15*b*.

According to the liquid ejecting apparatus 100B of the second embodiment, a sealing property of the pressure chamber 13 can be enhanced by the flow channel wall portion 31. Further, since displacement of the flow channel wall portion 31 in the second direction D2 is guided by the inclined wall surface 70, the flow channel wall portion 31 can be bent and deformed as specified, and the displacement operation of the flow channel wall portion 31 becomes smoother. In addition, according to the liquid ejecting apparatus 100B of the second embodiment, various operational effects which are the same as those described in the first embodiment in addition to the effects described in the second embodiment can be achieved.

3. Third Embodiment

Figure 6:
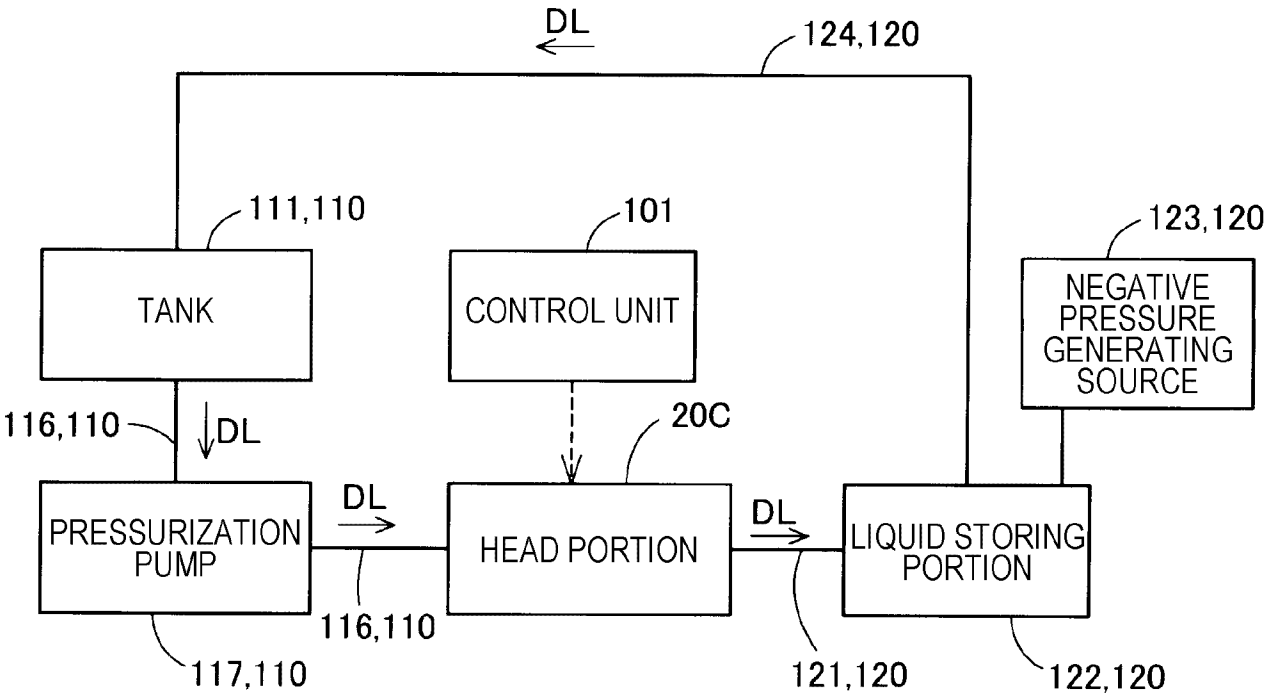
FIG. 6 is a schematic block diagram illustrating the overall configuration of a liquid ejecting apparatus according to a third embodiment.

FIG. 6 is a schematic block diagram illustrating the overall configuration of a liquid ejecting apparatus 100C according to a third embodiment. The liquid ejecting apparatus 100C of the third embodiment is substantially the same as the liquid ejecting apparatus 100A (FIG. 1) of the first embodiment except for those described below. The supply portion 110 of the liquid ejecting apparatus 100C includes a pressurization pump 117 instead of the pressure adjusting portion 115 and includes a head portion 10C of the third embodiment instead of the head portion 10A of the first embodiment. The liquid ejecting apparatus 100C further includes a circulation portion 120. The circulation portion 120 includes a discharge channel 121, a liquid storing portion 122, a negative pressure generating source 123, and a circulation channel 124.

The pressurization pump 117 pumps the liquid DL in the tank 111 to the head portion 10C through the supply channel 116. A configuration of the head portion 10C will be described below. The discharge channel 121 connects the head portion 10C and the liquid storing portion 122. The liquid DL not used for discharge by the head portion 10C is discharged to the liquid storing portion 122 through the discharge channel 121. The negative pressure generating source 123 is connected to the liquid storing portion 122. The negative pressure generating source 123 suctions the liquid DL from the head portion 10C through the discharge channel 121 by setting the inside of the liquid storing portion 122 to a negative pressure. The negative pressure generating source 123 is configured with various pumps.

In the liquid ejecting apparatus 100C, the pressure of the pressure chamber 13 (illustrated in FIG. 7 which will be referenced below) of a head portion 10D is adjusted by pressurization by the pressurization pump 117 and depressurization by the negative pressure generating source 123. In the liquid ejecting apparatus 100C, one of the pressurization pump 117 and the negative pressure generating source 123 will be omitted. When the pressurization pump 117 is omitted, it can be interpreted that the negative pressure generating source 123 functions as one component of the supply portion 110 that generates a pressure for supplying the liquid DL from the tank 111 to the head portion 10C.

The circulation channel 124 is a flow channel for allowing the liquid DL discharged from the head portion 10C through the discharge channel 121 to circulate in the pressure chamber 13 of the head portion 10C. The circulation channel 124 connects the liquid storing portion 122 and the tank 111. The liquid DL stored in the liquid storing portion 122 through the discharge channel 121 returns to the tank 111 through the circulation channel 124 and is supplied to the pressure chamber 13 of the head portion 10C through the supply channel 116 again. The circulation channel 124 may be provided with a pump for suctioning liquid from the liquid storing portion 122.

In the liquid ejecting apparatus 100C, since the circulation portion 120 is provided, the liquid DL flowing out from the head portion 10C can be reused. Thus, wasteful consumption of the liquid DL can be suppressed and utilization efficiency of the liquid DL can be enhanced. An adjustment portion that adjusts various states such as concentration, viscosity, temperature of the reused liquid DL may be provided in the liquid storing portion 122 and the tank 111. Further, a filter portion for removing air bubbles and foreign matters contained in the liquid DL may be provided in the discharge channel 121 and the circulation channel 124.

Figure 7:
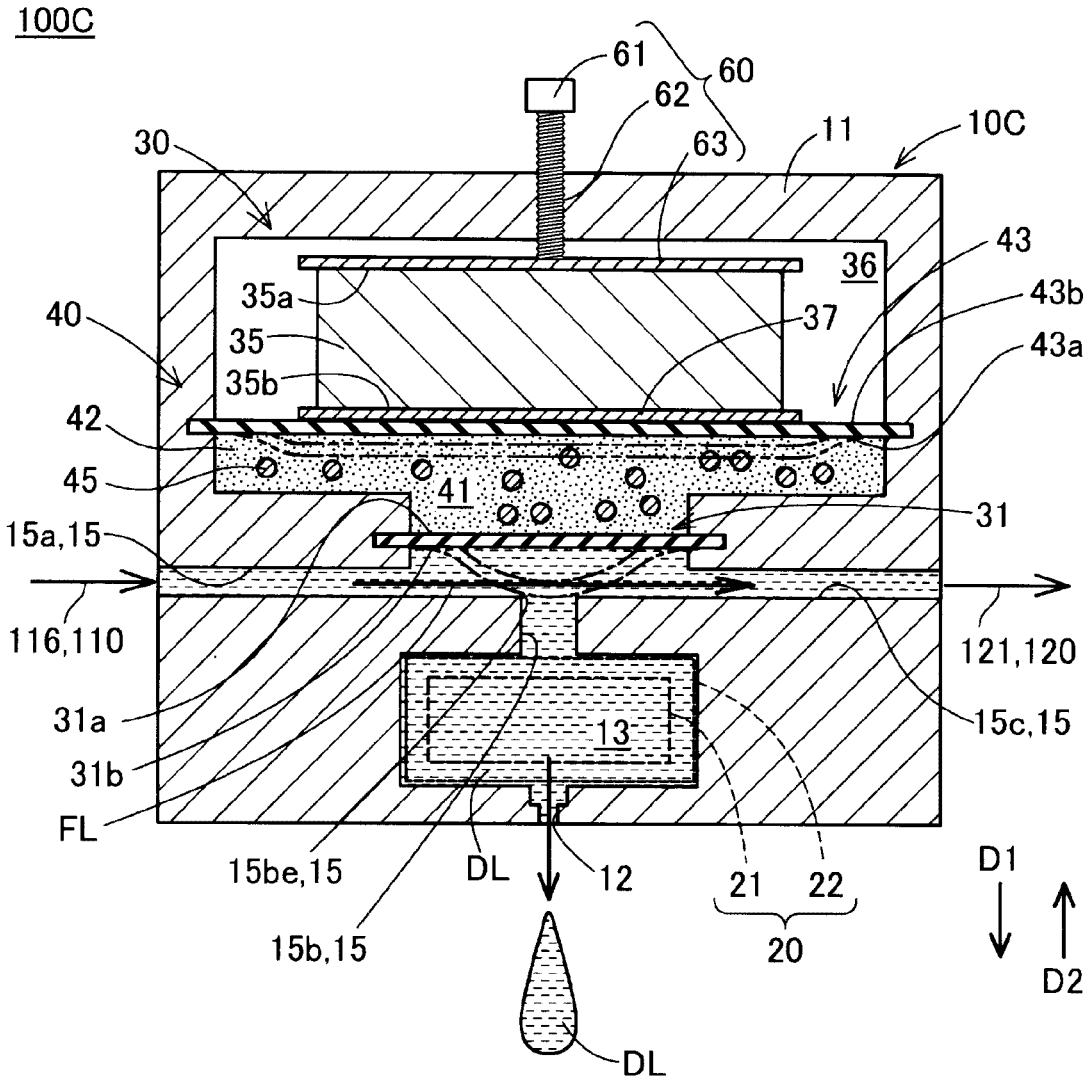
FIG. 7 is a schematic cross-sectional view schematically illustrating a configuration of a head portion of the third embodiment.

FIG. 7 is a schematic cross-sectional view schematically illustrating a configuration of a head portion 10C of the third embodiment. A configuration of the head portion 10C of the third embodiment is substantially the same as the configuration of the head portion 10A (FIG. 2) of the first embodiment except that a circulation flow channel 15*c* is added to the flow channel 15.

The circulation flow channel 15*c* is connected to the supply flow channel 15*a* on a downstream side of the communication flow channel 15*b*. The circulation flow channel 15*c* is connected to the discharge channel 121 of the circulation portion 120. A negative pressure that causes the liquid DL to flow into the circulation flow channel 15*c* by the circulation portion 120 (FIG. 6) is generated in the circulation flow channel 15*c*. Accordingly, the liquid DL that does not flow into the pressure chamber 13 through the communication flow channel 15*b* and the liquid DL that flows out from the pressure chamber 13 through the communication flow channel 15*b* flow out to the discharge channel 121 through the circulation flow channel 15*c*.

In the head portion 10C of the liquid ejecting apparatus 100C, the flow of the liquid DL from the pressure chamber 13 to the circulation flow channel 15*c* can be generated. Thus, deterioration of the liquid DL generated by retention of the liquid DL in the head portion 10C, such as a concentration change according to accumulation of sedimentation components in the liquid DL in the head portion 10C and evaporation of solvent components in the liquid DL, is suppressed. Therefore, occurrence of defective discharge resulting from the deterioration of the liquid DL of the pressure chamber 13 is suppressed. Further, in the liquid ejecting apparatus 100C, even when the air bubbles are generated in the pressure chamber 13, the air bubbles together with the liquid DL can be discharged from the circulation flow channel 15*c*. Thus, the occurrence of the defective discharge resulting from the air bubbles in the pressure chamber 13 is suppressed.

In the head portion 10C, even when the flow channel wall portion 31 is bent and deformed until coming into contact with the inclined wall surface 70 to close the communication flow channel 15*b*, a space communicating with the supply flow channel 15*a* and the circulation flow channel 15*c* remains around the flow channel wall portion 31. Therefore, even when the communication flow channel 15*b* is closed by the flow channel wall portion 31, the liquid DL can continue to flow from the supply flow channel 15*a* to the circulation flow channel 15*c*, as indicated by arrow FL. Therefore, a rapid increase in the pressure of the supply flow channel 15*a* and a rapid decrease in the pressure of the circulation flow channel 15*c* are suppressed by displacing the flow channel wall portion 31 in the first direction D1. Thus, the flow of the liquid DL in the head portion 10D can smoothly continue. Further, a force, acting in a direction in which the displacement of the flow channel wall portion 31 caused by the pressure of the liquid DL is disturbed, can be reduced and the displacement operation of the flow channel wall portion 31 can be smoothed.

In the liquid ejecting apparatus 100C, the control unit 101 (FIG. 6) displaces the flow channel wall portion 31 in the first direction D1 according to a timing when the discharge pressure is generated in the pressure chamber 13 by the pressure generating portion 20, as described in the first embodiment. Accordingly, escaping of the discharge pressure to the supply flow channel 15*a* and the circulation flow channel 15*c* is suppressed through the communication flow channel 15*b*.

Further, in the liquid ejecting apparatus 100C, the control unit 101 displaces the flow channel wall portion 31 in the second direction D2 according to a timing when a negative pressure for separating the liquid droplets into the pressure chamber 13 is generated in the pressure generating portion 20, as described in the first embodiment. Since the circulation flow channel 15*c* in which the negative pressure is generated is provided in the head portion 10C, when the flow channel wall portion 31 is displaced in the second direction D2, the negative pressure can be generated in the pressure chamber 13 in a shorter time.

According to the liquid ejecting apparatus 100C of the third embodiment including the flow channel resistance changing portion 30 using the displacement amplifying mechanism 40, the various operational effects described in the first embodiment in addition to the various effects described in the third embodiment can be achieved.

4. Fourth Embodiment

Figure 8:
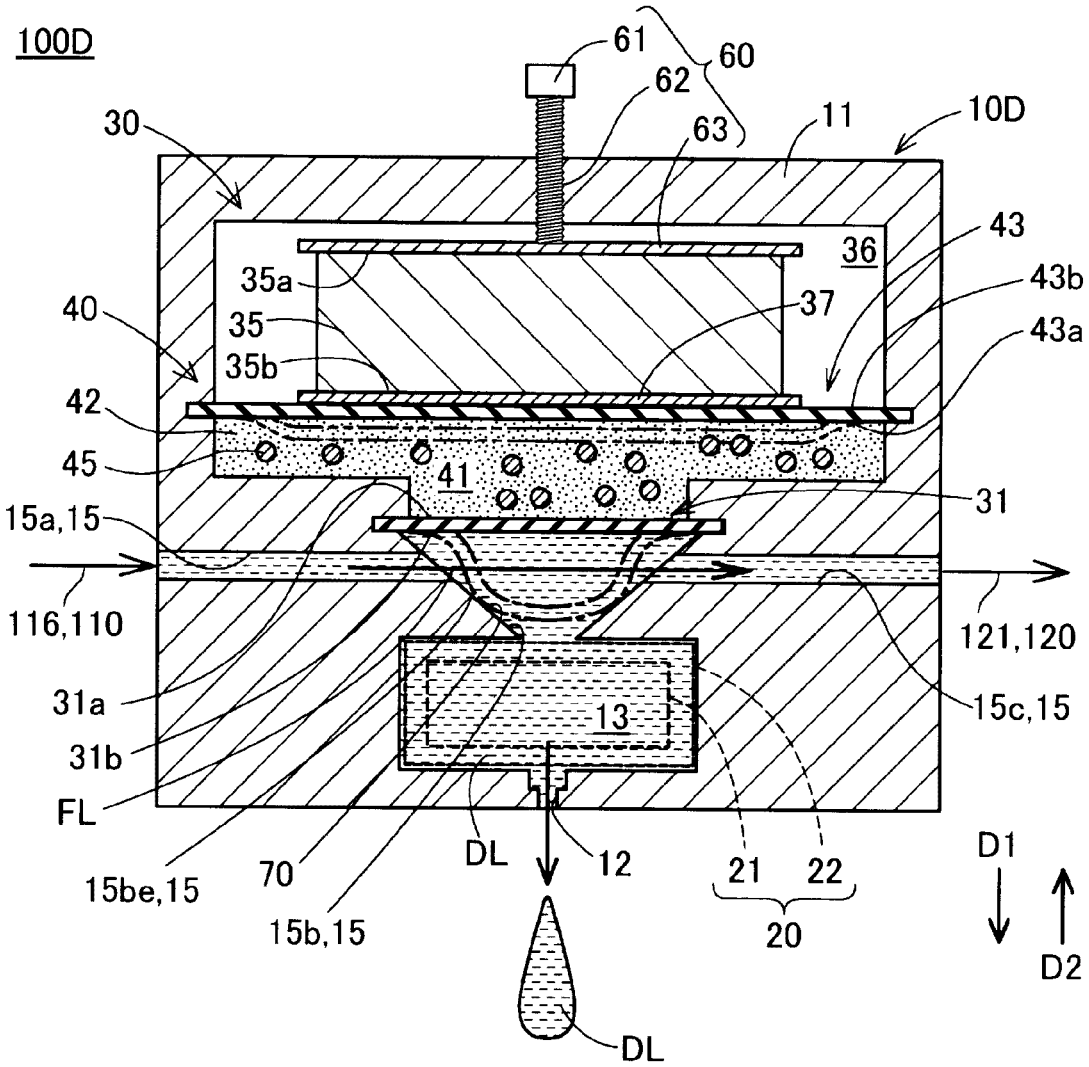
FIG. 8 is a schematic cross-sectional view schematically illustrating a configuration of a head portion of a fourth embodiment.

FIG. 8 is a schematic cross-sectional view schematically illustrating a configuration of a head portion 10D included in a liquid ejecting apparatus 100D of a fourth embodiment. A configuration of the liquid ejecting apparatus 100D of the fourth embodiment is substantially the same as the configuration of the liquid ejecting apparatus 100C (FIG. 6) of the third embodiment except that the head portion 10D of the fourth embodiment is included instead of the head portion 10C of the third embodiment. A configuration of the head portion 10D of the fourth embodiment is substantially the same as the configuration of the head portion 10B of the second embodiment except that the circulation flow channel 15*c* is added.

In the head portion 10D of the fourth embodiment, as the inclined wall surface 70 is provided in the communication flow channel 15*b*, a sealing property of the opening end portion 15*be* is enhanced by the flow channel wall portion 31, as described in the second embodiment. Further, the displacement operation of the flow channel wall portion 31 is smoothed. According to the liquid ejecting apparatus 100D of the fourth embodiment, since the circulation portion 120 is included, occurrence of problems resulting from retention of the liquid DL in the pressure chamber 13 can be suppressed, as described in the third embodiment.

Therefore, according to the liquid ejecting apparatus 100D of the fourth embodiment, the various effects described in the first embodiment, the second embodiment, and the third embodiment in addition to the various operational effects described in the fourth embodiments can be achieved.

5. Fifth Embodiment

Figure 9:
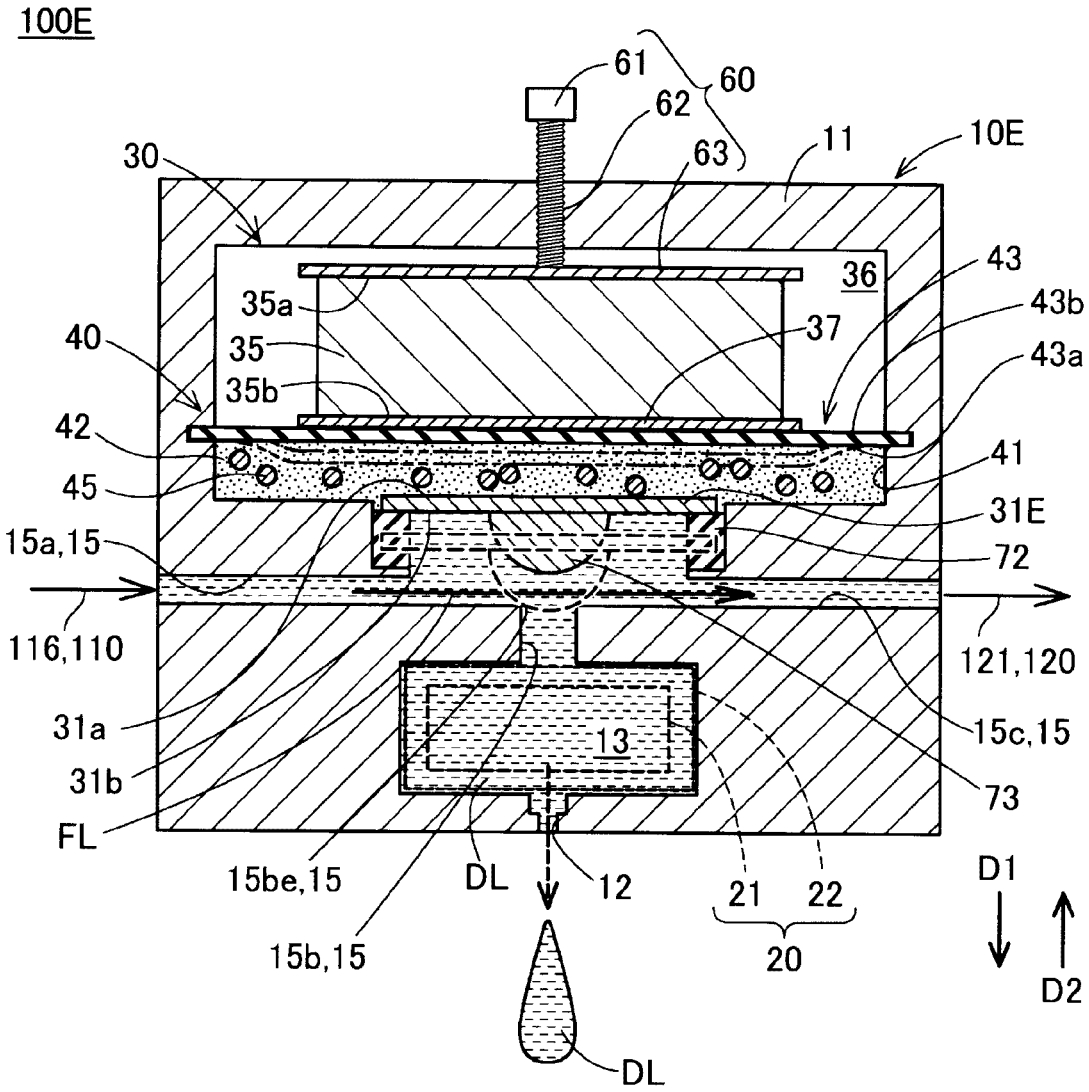
FIG. 9 is a schematic cross-sectional view schematically illustrating a configuration of a head portion of a fifth embodiment.

FIG. 9 is a schematic cross-sectional view schematically illustrating a configuration of a head portion 10E included in a liquid ejecting apparatus 100E of a fifth embodiment. A configuration of the liquid ejecting apparatus 100E of the fifth embodiment is substantially the same as the configuration (FIG. 6) of the liquid ejecting apparatus 100C of the third embodiment except that the head portion 10E of the fifth embodiment is included instead of the head portion 10C of the third embodiment. A configuration of the head portion 10E of the fifth embodiment is substantially the same as the configuration of the head portion 10C of the third embodiment except that a flow channel wall portion 31E and an elastic support member 72 that supports the flow channel wall portion 31E are added instead of the flow channel wall portion 31.

The flow channel wall portion 31E of the fifth embodiment is configured with, for example, a metal plate. It is preferable that the flow channel wall portion 31E have a rigidity enough to suppress occurrence of bending and deforming in the thickness direction due to a pressure received through the elastic material 42 of the accommodation chamber 41 when the actuator 35 is expanded. The flow channel wall portion 31E is not limited to the metal plate and may be configured with other members. The flow channel wall portion 31E may be configured with, for example, a resin plate. Ribs for suppressing the bending and deforming may be formed on wall surfaces 31*a* and 31*b* of the flow channel wall portion 31E.

The flow channel wall portion 31 has a protrusion portion 73 protruding toward the opening end portion 15*be* at a position facing the opening end portion 15*be* of the second wall surface 31*b*. In the specification, the term "facing" includes a state in which another object is interposed between the facing objects. The protrusion portion 73 may be configured to have, for example, a semispherical shape. The protrusion portion 73 functions as a lid portion that closes the opening end portion 15*be* when the flow channel wall portion 31E is displaced in the first direction D1. The protrusion portion 73 may be configured with a member that is different from that of the flow channel wall portion 31 or may be configured with the same member. The protrusion portion 73 may be configured to completely close the opening end portion 15*be* or may be omitted. A connection portion between the supply flow channel 15*a* and the communication flow channel 15*b* is configured such that a space remains around the protrusion portion 73 such that the liquid DL can flow as indicated by arrow FL when the protrusion portion 73 closes the opening end portion 15*be*.

As an outer peripheral end portion of the flow channel wall portion 31E is supported by the elastic support member 72, the flow channel wall portion 31E is fixed to the housing 11 while being displaceable in the thickness direction. The elastic support member 72 has a frame-like shape surrounding a central portion of the flow channel wall portion 31E. In the fifth embodiment, the elastic support member 72 is disposed in a stepped portion provided in the flow channel 15 and supports the flow channel wall portion 31E from the flow channel 15 side in a state in which the flow channel wall portion 31E can be displaced in the first direction D1 and the second direction D2. The elastic support member 72 functions as a sealing portion that prevents leakage of the liquid DL from the flow channel 15 to the accommodation chamber 41.

When the actuator 35 is expanded to displace the sealing wall portion 43, the flow channel wall portion 31E receives a pressure from the elastic material 42 of the accommodation chamber 41. Then, the elastic support member 72 is compressed so that the flow channel wall portion 31E is displaced in the first direction D1 as indicated by a one-dot chain line in a state in which an elastic force is generated in the second direction D2. A displacement amount of the flow channel wall portion 31E becomes more than a displacement amount of the actuator 35 by the displacement amplifying mechanism 40. Thus, in the head portion 10E, control accuracy of the flow channel resistance of the flow channel 15 is enhanced, which is like the head portion 10A of the first embodiment.

A configuration excluding the circulation flow channel 15*c*, which is like the head portion 10A of the first embodiment, may be applied to the head portion 10E. Further, a configuration in which the inner peripheral wall surface of the opening end portion 15*be* constitutes the inclined wall surface 70 in the communication flow channel 15*b*, which is like the head portion 10B of the second embodiment and the head portion 10D of the fourth embodiment, may be applied.

In the head portion 10E of the fifth embodiment, since the bending and deforming of the flow channel wall portion 31E when the flow channel wall portion 31E is displaced is suppressed, absorption of the pressure transmitted from the elastic material 42 by the bending and deforming of the flow channel wall portion 31E is suppressed. Therefore, according to the head portion 10E of the fifth embodiment, the pressure generated by the actuator 35 can be efficiently used for control of the flow channel resistance by the flow channel resistance changing portion 30. Further, deterioration of the flow channel wall portion 31E caused by repetition of the bending and deforming is suppressed. According to the liquid ejecting apparatus 100E of the fifth embodiment, the various effects described in the above-described embodiments in addition to the various operational effects described in the fifth embodiment can be achieved.

6. Sixth Embodiment

Figure 10:
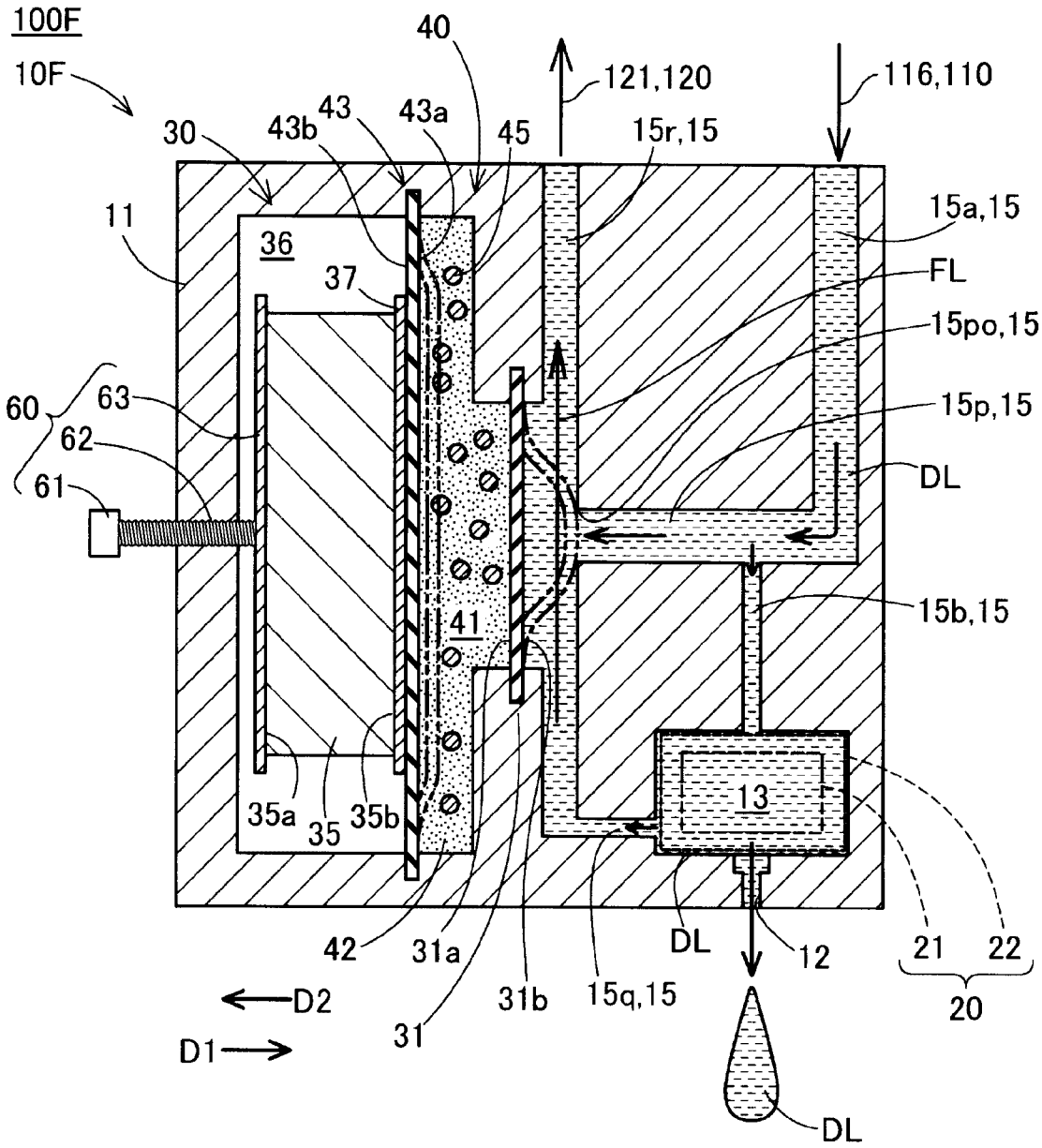
FIG. 10 is a schematic cross-sectional view schematically illustrating a configuration of a head portion of a sixth embodiment.

FIG. 10 is a schematic cross-sectional view schematically illustrating a configuration of a head portion 10F included in a liquid ejecting apparatus 100F of a sixth embodiment. A configuration of the liquid ejecting apparatus 100F of the sixth embodiment is substantially the same as the configuration (FIG. 6) of the liquid ejecting apparatus 100C of the third embodiment except that the head portion 10F of the sixth embodiment is included instead of the head portion 10C of the third embodiment. A configuration of the head portion 10F of the sixth embodiment is substantially the same as the configuration of the head portion 10C of the third embodiment except that the configuration of the flow channel 15 is changed and a position where the flow channel resistance changing portion 30 is provided is changed.

In the head portion 10F of the sixth embodiment, a first circulation flow channel 15*p* and a second circulation flow channel 15*q* are added as the flow channel 15 in addition to the supply flow channel 15*a* and the communication flow channel 15*b*. Further, a joining circulation flow channel 15*r* is provided instead of the circulation flow channel 15*c*.

The first circulation flow channel 15*p* is connected to the supply flow channel 15*a* on a downstream side of the communication flow channel 15*b*. The liquid DL mainly flows from the supply flow channel 15*a* to the first circulation flow channel 15*p*. The second circulation flow channel 15*q* is connected to the pressure chamber 13. The liquid DL in the pressure chamber 13 flows to the second circulation flow channel 15*q*. It is preferable that the second circulation flow channel 15*q* be connected to the pressure chamber 13 in a position that is closer to the nozzle 12 than to the communication flow channel 15*b*.

The joining circulation flow channel 15*r* is connected to the first circulation flow channel 15*p* and the second circulation flow channel 15*q*. The joining circulation flow channel 15*r* is connected to the discharge channel 121 of the circulation portion 120. The joining circulation flow channel 15*r* generates a negative pressure that causes the liquid DL to flow into the joining circulation flow channel 15*r*, by the circulation portion 120. Accordingly, a part of the liquid DL of the supply flow channel 15*a* flows into the joining circulation flow channel 15*r* through the first circulation flow channel 15*p* and the other part of the liquid DL flows into the pressure chamber 13 through the communication flow channel 15*b*. The liquid DL of the pressure chamber 13, which is not used for discharge from the nozzle 12, flows into the joining circulation flow channel 15*r* through the second circulation flow channel 15*q*. The liquid DL flowing into the joining circulation flow channel 15*r* from the first circulation flow channel 15*p* and the second circulation flow channel 15*q* is discharged to the discharge channel 121 and is supplied to the head portion 10F through the supply portion 110 again.

The flow channel resistance changing portion 30 is provided in the joining circulation flow channel 15*r*. As the flow channel wall portion 31 is displaced to the joining circulation flow channel 15*r* under the control of the control unit 101 (FIG. 6), the flow channel resistance changing portion 30 changes an opening cross-section of a part of the joining circulation flow channel 15*r* and changes the flow channel resistance of the flow channel 15.

The first circulation flow channel 15*p* has a connection opening 15*po* that is opened in the joining circulation flow channel 15*r* at an end portion. The flow channel wall portion 31 is provided at a position facing the first circulation flow channel 15*p*. The flow channel wall portion 31 is bent and deformed to close the connection opening 15*po* when the actuator 35 is expanded, as indicated by a one-dot chain line, and is displaced in the first direction D1 in a state in which an elastic force acting in the second direction D2 is generated. The flow channel resistance changing portion 30 includes the displacement amplifying mechanism 40, the displacement amount of the flow channel wall portion 31 becomes more than the displacement amount of the actuator 35, as described in the first embodiment.

Even when the flow channel wall portion 31 is displaced in the first direction D1 to close the connection opening 15*po*, the joining circulation flow channel 15*r* is configured such that a space through which the liquid DL flows remains around the flow channel wall portion 31. Accordingly, even in a state in which the connection opening 15*po* is closed by the flow channel wall portion 31, the flow of the liquid DL in the joining circulation flow channel 15*r* continues, as indicated by arrow FL. As the connection opening 15*po* is closed by the flow channel wall portion 31, inflow of the liquid DL from the supply flow channel 15*a* via the communication flow channel 15*b* to the pressure chamber 13 can be promoted. Thus, the pressure chamber 13 can be filled with the liquid DL at a short time.

In the liquid ejecting apparatus 100F, the control unit 101 (FIG. 6) controls, for example, the flow channel resistance changing portion 30 as follows. In a standby state in which the liquid DL is not discharged from the nozzle 12, the control unit 101 opens the connection opening 15*po* to set the flow channel resistance of the connection opening 15*po* to a low state so as to promote circulation of the liquid DL through the first circulation flow channel 15*p* and the joining circulation flow channel 15*r*. Accordingly, the retention of the liquid DL in the pressure chamber 13 is suppressed. At this time, the pressure of the pressure chamber 13 is adjusted to the meniscus withstand pressure or less.

When the discharge of the liquid DL from the nozzle 12 is started, first, the control unit 101 displaces the flow channel wall portion 31 toward the connection opening 15*po* to increase the flow channel resistance of the connection opening 15*po*. The control unit 101 may close the connection opening 15*po* by the flow channel wall portion 31. Accordingly, the flow of the liquid DL from the supply flow channel 15*a* to the first circulation flow channel 15*p* is suppressed, and the filling of the liquid DL into the pressure chamber 13 through the communication flow channel 15*b* is promoted.

Next, in a state in which the flow channel resistance of the connection opening 15*po* is increased, the control unit 101 generates a discharge pressure inside the pressure chamber 13 by the pressure generating portion 20. Since the inflow of the liquid DL into the first circulation flow channel 15*p* is suppressed due to the high flow channel resistance of the connection opening 15*po*, escaping of the discharge pressure inside the pressure chamber 13 through the communication flow channel 15*b* is suppressed and discharge efficiency of the liquid DL by the head portion 10F is enhanced.

After the discharge of the liquid DL from the nozzle 12 is started, the control unit 101 increases the volume of the pressure chamber 13 by the pressure generating portion 20. Accordingly, a negative pressure that pulls back the liquid DL of the nozzle 12 to the pressure chamber 13 can be generated in the pressure chamber 13, and separation of the liquid droplets of the liquid DL from the liquid DL in the nozzle 12 can be promoted. The control unit 101 displaces the flow channel wall portion 31 in the second direction D2 according to a generation timing of the negative pressure, and reduces the flow channel resistance of the connection opening 15*po*. Accordingly, since the inflow of the liquid DL into the pressure chamber 13 through the communication flow channel 15*b* is suppressed, disturbance of a reduction in the pressure of the pressure chamber 13 is suppressed by the liquid DL supplied from the communication flow channel 15*b*. Thus, the liquid droplets of the liquid DL can be more certainly separated from the liquid DL inside the nozzle 12.

In particular, in the sixth embodiment, since the flow channel wall portion 31 is provided at a position facing the connection opening 15*po*, as the flow channel wall portion 31 is displaced in the second direction D2, an instantaneous reduction in the pressure can be caused in the first circulation flow channel 15*p* and the communication flow channel 15*b*. Thus, generation efficiency of the negative pressure inside the pressure chamber 13 can be enhanced, and the separation of the liquid droplets from the liquid DL inside the nozzle 12 can be promoted.

According to the liquid ejecting apparatus 100F of the sixth embodiment, since the second circulation flow channel 15*q* connected to the pressure chamber 13 is included in addition to the first circulation flow channel 15*p* connected to the supply flow channel 15*a*, the retention of the liquid DL in the pressure chamber 13 can be more effectively suppressed. Further, as the flow channel resistance is controlled by the flow channel resistance changing portion 30, a supply pressure of the liquid DL to the pressure chamber 13 can be controlled while the liquid DL circulates, which is efficient. Therefore, according to the liquid ejecting apparatus 100F of the sixth embodiment, the various operation effects described in the above-described embodiments in addition to the various operational effects described in the sixth embodiment can be achieved. 7. Other embodiments:

For example, various configurations described in the above embodiments can be modified as follows. Any one of modifications described below is considered as one example of a mode for implementing the invention.

7-1. Another Embodiment 1

In the above-described embodiments, as the flow channel wall portion 31 is disposed to face the opening end portion 15*be* and the connection opening 15*po*, the flow channel resistance changing portion 30 changes the flow channel resistances of the flow channels in connection portions between the plurality of flow channels. In contrast, the flow channel wall portion 31 of the flow channel resistance changing portion 30 may not be provided at the position described in the above embodiments. The flow channel wall portion 31 may be provided at a predetermined position of the flow channel 15 to change the flow channel resistance of the flow channel 15. The flow channel wall portion 31 may be provided at the center of, for example, the supply flow channel 15*a*, the communication flow channel 15*b*, the circulation flow channel 15*c*, and the second circulation flow channel 15*q*.

7-2. Another Embodiment 2

The configuration of the flow channel 15 and the arrangement configuration of the flow channel resistance changing portion 30 in the head portions 10A to 10F of the embodiments are not limited to the illustrated configurations. For example, the supply flow channel 15*a* and the circulation flow channel 15*c* may not extend in a horizontal direction or the communication flow channel 15*b* may not extend along the gravity direction. Further, for example, the flow channel resistance changing portion 30 may be configured such that the displacement direction of the flow channel wall portion 31 and the displacement direction of the actuator 35 are different from each other. Further, the flow channel wall portion 31 and the sealing wall portion 43 may be arranged to face each other with the elastic material 42 interposed therebetween or may be arranged at positions offset from each other.

7-3. Another Embodiment 3

In the above-described embodiments, the elastic material 42 may be disposed in the accommodation chamber 41 while being formed in advance according to the shape of the accommodation chamber 41 or may be formed by injecting a raw material into the accommodation chamber 41 while having fluidity. The elastic material 42 may not be formed of a material, the shape of which is maintained when the material is extracted from the accommodation chamber 41, or may be formed of, for example, gel having both fluidity and elasticity. The elastic material 42 is not limited to a rubber-like elastic body. As described in the first embodiment, the elastic material 42 can be formed of a material, such as liquid, exhibiting a fluidic behavior in which pressure can be transmitted in all directions inside the elastic material 42 when the pressure is applied. It is preferable that the elastic material 42 be made of a material, the volume of which is hard to be compressed when the pressure is applied from the outside.

7-4. Another Embodiment 4

In the sixth embodiment, a configuration of the flow channel wall portion 31E of the fifth embodiment, which is supported by the elastic support member 72, may be applied instead of the flow channel wall portion 31 configured as a diaphragm.

7-5. Another Embodiment 5

In the above-described embodiments, the flow channel wall portion 31 is formed of a material that is bent and deformed in a state in which an elastic force is generated in the second direction D2 when the material is bent and deformed in the first direction D1 from the accommodation chamber 41 to the pressure chamber 13. In contrast, the flow channel wall portion 31 may be configured with a film-like member that hardly generates an elastic force enough to restore the shape of the flow channel wall portion 31 when an external force is released.

A material constituting the flow channel wall portion 31 is not particularly limited. The flow channel wall portion 31 can be formed of, for example, various materials which will be described below. The flow channel wall portion 31 may be formed of natural rubber (NR), synthetic natural rubber, butadiene rubber (BR), butyl rubber (IIR), nitrile rubber (NBR), ethylene/propylene rubber (EPM), chloroprene rubber (CR), acrylic rubber (ACM), fluoro rubber (FKM), ethylene/vinyl acetate rubber, epichlorohydrin rubber (CO, ECO), polysulfide rubber, or the like.

Further, the flow channel wall portion 31 may be formed of, for example, polyethylene or polypropylene (PP), polystyrene (PS), polyvinyl chloride (PVC), nylon, polyethylene terephthalate (PET), polycarbonate (PC), polyvinylidene fluoride resin (PVDF Resin), an EVOH resin, or the like. Similarly to the flow channel wall portion 31, the sealing wall portion 43 may be formed to the above-described materials.

The shape of the flow channel wall portion 31 is not limited to a flat shape having a substantially uniform thickness. The flow channel wall portion 31 may have, for example, a configuration in which the flow channel wall portion 31 is bent into a bellows to be bent and deformed in the thickness direction or a configuration in which a groove for reducing the thickness and making the bending easy is provided. In the above-described embodiments, the flow channel wall portion 31 may be formed of the same material as that of the elastic material 42. Further, the flow channel wall portion 31 may be configured as a part of the elastic material 42.

7-6. Another Embodiment 6

In the above-described embodiments, the sealing wall portion 43 may be omitted. In this case, it is preferable that a gap that is equal to or less than a width for obtaining a flow channel resistance at which the elastic material 42 pressed by the actuator 35 does not flow toward the actuator 35 be formed between the actuator 35 and the side wall surface of the accommodation chamber 41. Further, a configuration may be adopted in which the gap is filled with adhesive. It is preferable that a material that can be deformed so as not to be broken due to the displacement of the actuator 35 be used as such adhesive.

7-7. Another Embodiment 7

In the above-described embodiments, the sealing wall portion 43 is configured with a member that is bent and deformed. In contrast, the sealing wall portion 43 may be configured with a plate-shaped member having rigidity at which bending and deforming is hardly caused. In this case, the sealing wall portion 43 is disposed between the actuator 35 and the elastic material 42 in a state in which an outer peripheral end portion of the sealing wall portion 43 is not fixed to the housing 11, so as to move according to the displacement of the actuator 35. In this configuration, it is preferable that a gap between the outer peripheral end portion of the sealing wall portion 43 and the side wall surface of the accommodation chamber 41 have a width for obtaining a flow channel resistance at which movement of the elastic material 42 pressed by the actuator 35 toward the actuator 35 is suppressed. Alternatively, the gap between the outer peripheral end portion of the sealing wall portion 43 and the side wall surface of the accommodation chamber 41 may be filled with adhesive. In this case, it is preferable that a material that can be deformed so as not to be broken due to the displacement of the actuator 35 be used as the adhesive.

7-8. Another Embodiment 8

In the above-described embodiments, the actuator 35 may be configured with a piezo element. The actuator 35 may be configured with various elements or devices that can generate displacement of, for example, an air cylinder, a solenoid, a magnetostrictive element, or the like.

7-9. Another Embodiment 9

In the above-described embodiments, the liquid ejecting apparatuses 100A to 100F adopt a discharge mechanism that discharges the liquid DL by bending and deforming of the diaphragm caused by the discharge actuator 22 configured with a piezo element. The liquid ejecting apparatuses 100A to 100F are not limited to such a discharge mechanism, and may be configured to discharge the liquid DL from the nozzle 12 by other discharge mechanisms. For example, the liquid ejecting apparatuses 100A to 100F may adopt a mechanism that discharges the liquid DL from the nozzle 12 by causing a piston to reciprocate in the pressure chamber 13.

7-10. Another Embodiment 10

The liquid ejecting apparatuses 100A to 100F of the above-described embodiments are not limited to a liquid ejecting apparatus for discharging ink and may be realized as a liquid ejecting apparatus that discharges various liquids. For example, the liquid ejecting apparatuses 100A to 100F may be realized as various liquid ejecting apparatuses as follows.

(1) An image recording apparatus such as a facsimile apparatus.

(2) A color material discharging apparatus used for manufacturing a color filter for an image display device such as a liquid crystal display.

(3) An electrode material discharging apparatus used for forming an electrode of an organic electro luminescence (EL) display, a field emission display (FED), or the like.

(4) A liquid ejecting apparatus for discharging a liquid containing a bioorganic matter used for manufacturing a bio chip.

(5) A sample discharging device as a precision pipette.

(6) Lubricating oil discharging device.

(7) Resin liquid discharging device.

(8) A liquid ejecting apparatus for discharging lubricating oil to a precision machine such as a watch or a camera using a pinpoint.

(9) A liquid ejecting apparatus for discharging a transparent resin liquid such as an ultraviolet curable resin liquid onto a substrate to form a micro hemispherical lens (optical lens) or the like used for an optical communication element or the like.

(10) A liquid ejecting apparatus for discharging an acidic or alkaline etchant for etching a substrate or the like.

(11) A liquid ejecting apparatus comprising a liquid discharging head for discharging any other minute amount of liquid droplets.

In the specification, the "liquid" may be a material that can be consumed by the liquid ejecting apparatus. For example, the "liquid" may be a material, the matter of which is in a liquid phase, and also includes liquid-state materials having high or low viscosity and liquid-state materials such as sol, gel water, other inorganic solvent, organic solvent, solution, liquid resin, and liquid metal (metal melt). Further, the "liquid" includes not only liquid as one state of matter but also solutions obtained by dissolving, dispersing, or mixing, in a solvent, particles of a functional material formed of a solid matter such as pigment or metallic particles. Representative examples of the liquid include ink, liquid crystal, and the like. Here, the ink includes various liquid compositions such as general water-based ink and oil-based ink, gel ink, and hot melt ink. Further, the "liquid droplets" refer to a state of liquid discharged from the liquid ejecting apparatus, and has a grain shape, a teardrop shape, or a shape having a thread-like tail.

7-11. Another Embodiment 11

In the above-described embodiments, some or all of functions and processes realized by software may be realized by hardware. Further, some or all of functions and processes realized by hardware may be realized by software. For example, various circuits such as an integrated circuit, a discrete circuit, or a circuit module obtained by combining these circuits can be used as the hardware.

The invention is not limited to the above-described embodiments, examples, and modifications, and can be realized in various configurations without departing from the spirit thereof. For example, technical features in the embodiments, examples, and modifications corresponding to technical features of aspects described in Summary can be appropriately replaced or combined in order to solve some or all of the above-described problems or in order to achieve some or all of the above-described problems. Further, the invention is not limited to the technical features described as being not essential in the specification, and when it is described that the technical features is not essential in the specification, the technical features can be removed.

The entire disclosure of Japanese Patent Application No.: 2017-229813, filed Nov. 30, 2017 is expressly incorporated by reference herein.

What is claimed is:

1. A liquid ejecting apparatus comprising:

a nozzle that discharges a liquid;

a pressure chamber that communicates with the nozzle, accommodates the liquid, and generates a pressure for discharging the liquid from the nozzle;

a flow channel which is connected to the pressure chamber and through which the liquid flows;

a flow channel wall portion that constitutes a part of a wall surface of the flow channel, is displaced to change a cross-sectional area of a part of the flow channel, and changes a flow channel resistance of the flow channel; and an actuator that displaces the flow channel wall portion, wherein an displacement amplifying mechanism for increasing a displacement amount of the flow channel wall portion more than a displacement amount of the actuator is provided between the actuator and the flow channel wall portion, wherein the displacement amplifying mechanism includes an elastic material that is connected to the actuator and is elastically deformed by displacement of the actuator, and an accommodation chamber that is partitioned from the flow channel by the flow channel wall portion and accommodates the elastic material on the flow channel wall portion, and wherein a first portion of the elastic material receiving a pressure from the actuator, a second portion of the flow channel wall portion being bent and deformed between the flow channel and the accommodation chamber by receiving a pressure from the elastic material, an area of the second portion being less than an area of the first portion.

2. The liquid ejecting apparatus according to claim 1, wherein the flow channel wall includes a diaphragm that, when the flow channel wall portion is displaced in the first direction, is bent and deformed to generate an elastic force acting in a second direction that is opposite to the first direction.

3. The liquid ejecting apparatus according to claim 1, wherein the displacement amplifying mechanism further includes a sealing wall portion that is disposed between the actuator and the elastic material, seals the accommodation chamber, and is displaced according to the displacement of the actuator.

4. The liquid ejecting apparatus according to claim 1, wherein the flow channel includes a supply flow channel that supplies the liquid to be supplied to the pressure chamber, and a communication flow channel that communicates with the supply flow channel and the pressure chamber and has an opening end portion that is opened in the supply flow channel, and wherein the flow channel wall portion is provided at a position facing the opening end portion of the communication flow channel in the supply flow channel, is displaced to close the opening end portion, and suppresses inflow of the liquid into the pressure chamber.

5. The liquid ejecting apparatus according to claim 4, wherein an inner peripheral wall surface on the opening end portion side in the communication flow channel is inclined such that an opening diameter of the communication flow channel increases toward the flow channel wall portion, and wherein when being displaced in a direction in which a cross-sectional area of the flow channel is reduced, the flow channel wall portion comes into contact with the inner peripheral wall surface to seal the communication flow channel.

6. The liquid ejecting apparatus according to claim 4, wherein the flow channel includes a circulation flow channel that is connected to the supply flow channel on a downstream side of the communication flow channel, and wherein the liquid ejecting apparatus further includes a circulation portion that generates a negative pressure in the circulation flow channel such that the liquid flows into the circulation flow channel, and circulates the liquid flowing into the circulation flow channel to the supply flow channel.

7. The liquid ejecting apparatus according to claim 1, wherein the flow channel includes a supply flow channel that supplies the liquid to the pressure chamber, a communication flow channel that communicates with the supply flow channel and the pressure chamber, a first circulation flow channel which is connected to the supply flow channel on a downstream side of the communication flow channel and into which the liquid flows from the supply flow channel, a second circulation flow channel which is connected to the pressure chamber and into which the liquid in the pressure chamber flows, and a joining circulation flow channel that is connected to the first circulation flow channel and the second circulation flow channel, wherein the liquid ejecting apparatus further includes a circulation portion that generates a negative pressure in the joining circulation flow channel such that the liquid flows from the first circulation flow channel and the second circulation flow channel into the joining circulation flow channel, and circulates the liquid flowing into the joining circulation flow channel to the supply flow channel, wherein the first circulation flow channel has a connection opening that is opened in the joining circulation flow channel, and wherein the flow channel wall portion is provided to face the connection opening in the joining circulation flow channel and is displaced to close the connection opening.

8. The liquid ejecting apparatus according to claim 1, wherein the flow channel wall portion is supported by an elastic support member, and wherein when the actuator is displaced to apply a pressure to the elastic material, the elastic support member is deformed to generate an elastic force acting in a direction from the flow channel to the accommodation chamber, and moves a position of the flow channel wall portion in a direction in which a cross-sectional area of the flow channel is reduced.

9. The liquid ejecting apparatus according to claim 1, wherein a filler having a compression ratio that is less than that of the elastic material is dispersed inside the elastic material.

10. The liquid ejecting apparatus according to claim 1, further comprising:

an adjustment portion that adjusts an initial position of the flow channel wall portion before the actuator is pressed toward the elastic material to be driven.

* * * * *